US008172644B2

(12) United States Patent
Mizutani et al.

(10) Patent No.: US 8,172,644 B2
(45) Date of Patent: May 8, 2012

(54) GRINDING MACHINE AND GRINDING METHOD

(75) Inventors: Yoshihiro Mizutani, Kitanagoya (JP); Hiroshi Morita, Hoi-gun (JP); Yuuta Kobayashi, Kariya (JP)

(73) Assignee: JTEKT Corporation, Osaka-shi (JP)

( * ) Notice: Subject to any disclaimer, the term of this patent is extended or adjusted under 35 U.S.C. 154(b) by 418 days.

(21) Appl. No.: 12/421,063

(22) Filed: Apr. 9, 2009

(65) Prior Publication Data

US 2009/0258576 A1 Oct. 15, 2009

(30) Foreign Application Priority Data

Apr. 11, 2008 (JP) ..... 2008-104130

(51) Int. Cl.
*B24B 49/00* (2012.01)
*B24B 55/04* (2006.01)

(52) U.S. Cl. ..... 451/11; 451/49; 451/547

(58) Field of Classification Search ..... 451/49, 451/53, 60, 9–11, 242, 246, 251, 541, 547
See application file for complete search history.

(56) References Cited

U.S. PATENT DOCUMENTS

| | | | | |
|---|---|---|---|---|
| 3,916,579 | A * | 11/1975 | Waller et al. | 451/547 |
| 4,907,374 | A * | 3/1990 | Brill | 451/342 |
| 5,052,154 | A * | 10/1991 | Lehmann | 451/542 |
| 5,259,150 | A * | 11/1993 | Himmelsbach | 451/62 |
| 5,846,125 | A * | 12/1998 | Robichon | 451/450 |
| 5,975,995 | A * | 11/1999 | Hykes et al. | 451/62 |
| 6,409,573 | B1 * | 6/2002 | Mukai et al. | 451/5 |
| 6,878,043 | B1 * | 4/2005 | Junker | 451/49 |
| 2010/0041321 | A1 * | 2/2010 | Ido et al. | 451/53 |

FOREIGN PATENT DOCUMENTS

| | | |
|---|---|---|
| EP | 1 044 764 A2 | 10/2000 |
| GB | 2 208 275 A | 3/1989 |
| JP | 57-157458 | 10/1982 |
| JP | 2000-108026 | 4/2000 |
| JP | 2002-66931 | 3/2002 |

OTHER PUBLICATIONS

U.S. Appl. No. 12/442,627, filed Mar. 24, 2009, Masahiro Ido, et al.
U.S. Appl. No. 12/443,545, filed Mar. 30, 2009, Shinji Soma, et al.
U.S. Appl. No. 12/446,313, filed Apr. 20, 2009, Soma, et al.

* cited by examiner

*Primary Examiner* — Dung Van Nguyen
(74) *Attorney, Agent, or Firm* — Oblon, Spivak, McClelland, Maier & Neustadt, L.L.P.

(57) ABSTRACT

A grinding machine is provided with first and second grinding wheels selectively used in dependence on the steps of machining operations. The second grinding wheel is grooved so that at least one oblique groove vertically crosses a contact surface on which a grinding surface of the second grinding wheel contacts with a workpiece, and thus, is capable of releasing a dynamic pressure in coolant generated between the grinding surface and the workpiece since coolant supplied from over the contact surface flows out from both of the upper and lower sides of the contact surface through the at least one oblique groove. Since it does not occur that fluctuations in the dynamic pressure generated in coolant cause the distance between the second grinding wheel and the workpiece to be varied, the accuracy in grinding the workpiece with the second grinding wheel can be enhanced.

30 Claims, 14 Drawing Sheets

GRINDING MACHINE AND GRINDING METHOD

INCORPORATION BY REFERENCE

This application is based on and claims priority under 35 U.S.C. 119 with respect to Japanese patent application No. 2008-104130 filed on Apr. 11, 2008, the entire content of which is incorporated herein by reference.

BACKGROUND OF THE INVENTION

1. Field of the Invention

The present invention relates to a grinding machine and a grinding method for grinding a workpiece with a grinding wheel while coolant is being supplied to a contact surface on a grinding surface of the grinding wheel and the workpiece. Particularly, it relates to a grinding machine and a grinding method selectively using first and second grinding wheels in dependence upon the steps of grinding operations.

2. Discussion of the Related Art

Heretofore, in grinding a workpiece with a grinding wheel provided on a grinding machine, grinding burn, thermal stress and the like of the workpiece caused by the grinding heat are prevented by supplying coolant toward a grinding point between the workpiece and the grinding wheel for cooling and lubrication. However, where coolant is supplied toward the grinding point between the workpiece and the grinding wheel, a dynamic pressure is generated in the coolant between the workpiece and the grinding wheel. In particular, where the workpiece has a hole or groove, the same causes the dynamic pressure to fluctuate, which gives rises to a problem that the machining accuracy of the workpiece is deteriorated due to a relative displacement between the workpiece and grinding wheel. Japanese Utility Model Application No. 57-157458 discloses a technology for preventing the machining accuracy from being deteriorated due to such a dynamic pressure generated in the coolant.

In the technology described in the Japanese application, there is provided a coolant supply device capable of switching into two high and low levels the pressure of coolant supplied to a coolant nozzle which supplies coolant toward a grinding point at which the grinding wheel contacts a workpiece. The coolant pressure is switched into a high pressure during a rough grinding wherein the feed rate of the grinding wheel toward the workpiece is high, but into a low pressure during a finish grinding wherein the feed rate is low, as well as during a spark-out grinding. Thus, the machining accuracy is prevented from being deteriorated due to the dynamic pressure generated in the coolant.

However, in the prior art described above, it is impossible to release the dynamic pressure which is generated in the coolant supplied to a contact surface on which the grinding surface of the grinding wheel contacts the workpiece. In particular, where the rotational speeds of the grinding wheel and the workpiece are heightened to increase the grinding efficiency, the dynamic pressure generated in the coolant causes the machining accuracy to be deteriorated. For desired machining accuracy, it has to be done to lower the rotational speeds of the grinding wheel and the workpiece. This gives rises to a problem that the machining efficiency is lowered.

SUMMARY OF THE INVENTION

It is therefore an object of the present invention to provide an improved grinding machine with a grinding wheel which is capable of performing grinding operations on workpieces precisely, and to provide an improved grinding method using such a grinding wheel.

Briefly, according to the present invention, there is provided an improved grinding machine having first and second grinding wheels selectively used in dependence on steps of grinding operations for grinding a workpiece with each of the grinding wheels with coolant supplied to a contact surface on a grinding surface of each grinding wheel and the workpiece, wherein the first grinding wheel comprises a grinding wheel having a grinding surface formed to be plane and wherein the second grinding wheel comprises a grinding wheel having a plurality of oblique grooves formed on a grinding surface thereof to be inclined relative to a wheel circumferential direction.

With this construction, since the first grinding wheel has the grinding surface formed to be plane, whereas the second grinding wheel has the plurality of oblique grooves formed on the grinding surface thereof to be inclined relative to the wheel circumferential direction, the accuracy in grinding with the second grinding wheel and the service life of the second grinding wheel can be improved for the following reasons. That is, the first grinding wheel is a conventional grinding wheel and, even when used at such a grinding operation step as to shorten the service life of the second grinding wheel, does not suffer becoming remarkably short in service life. On the other hand, the second grinding wheel is capable of releasing a dynamic pressure in coolant generated between the grinding surface and the workpiece since coolant supplied from the upside is discharged from both of the upper and lower sides of the contact surface through at least one oblique groove. Therefore, without decreasing the supply quantity of coolant, it can be prevented that the workpiece is displaced in a direction to go away from the second grinding wheel due to a dynamic pressure in coolant or the dynamic pressure generated in the coolant fluctuates to vary the distance which the workpiece goes away from the second grinding wheel. As a result, it can be realized to enhance the accuracy in grinding the workpiece with the second grinding wheel. Moreover, since the first grinding wheel is used in such a grinding operation step as to shorten the service life of the second grinding wheel, it becomes possible to prolong the service life of the second grinding wheel.

In another aspect of the present invention, there is provided an improved grinding method for grinding a workpiece with each of first and second grinding wheels with coolant supplied to a contact surface on a grinding surface of each grinding wheel and the workpiece. The method comprises the steps of forming a grinding surface of the first grinding wheel to be plane, forming a plurality of oblique grooves on a grinding surface of the second grinding wheel to be inclined relative to a wheel circumferential direction, and selectively using the first and second grinding wheels in dependence on steps of grinding operations which are performed in turn on the workpiece.

With this construction, since the grinding operation with the first grinding wheel having the grinding surface formed to be plane and the grinding operation with the second grinding wheel having the plurality of oblique grooves inclined relative to the wheel circumferential direction are selectively performed in dependence on the steps of grinding operations, the accuracy in grinding with the second grinding wheel and the service life of the second grinding wheel can be improved for the reasons mentioned above in connection with the grinding machine.

BRIEF DESCRIPTION OF THE DRAWINGS

The foregoing and other objects and many of the attendant advantages of the present invention may readily be appreciated as the same becomes better understood by reference to the preferred embodiments of the present invention when considered in connection with the accompanying drawings, wherein like reference numerals designate the same or corresponding parts throughout several views, and in which.

DETAILED DESCRIPTION OF THE PREFERRED EMBODIMENT (First Embodiment)

Figure 1:
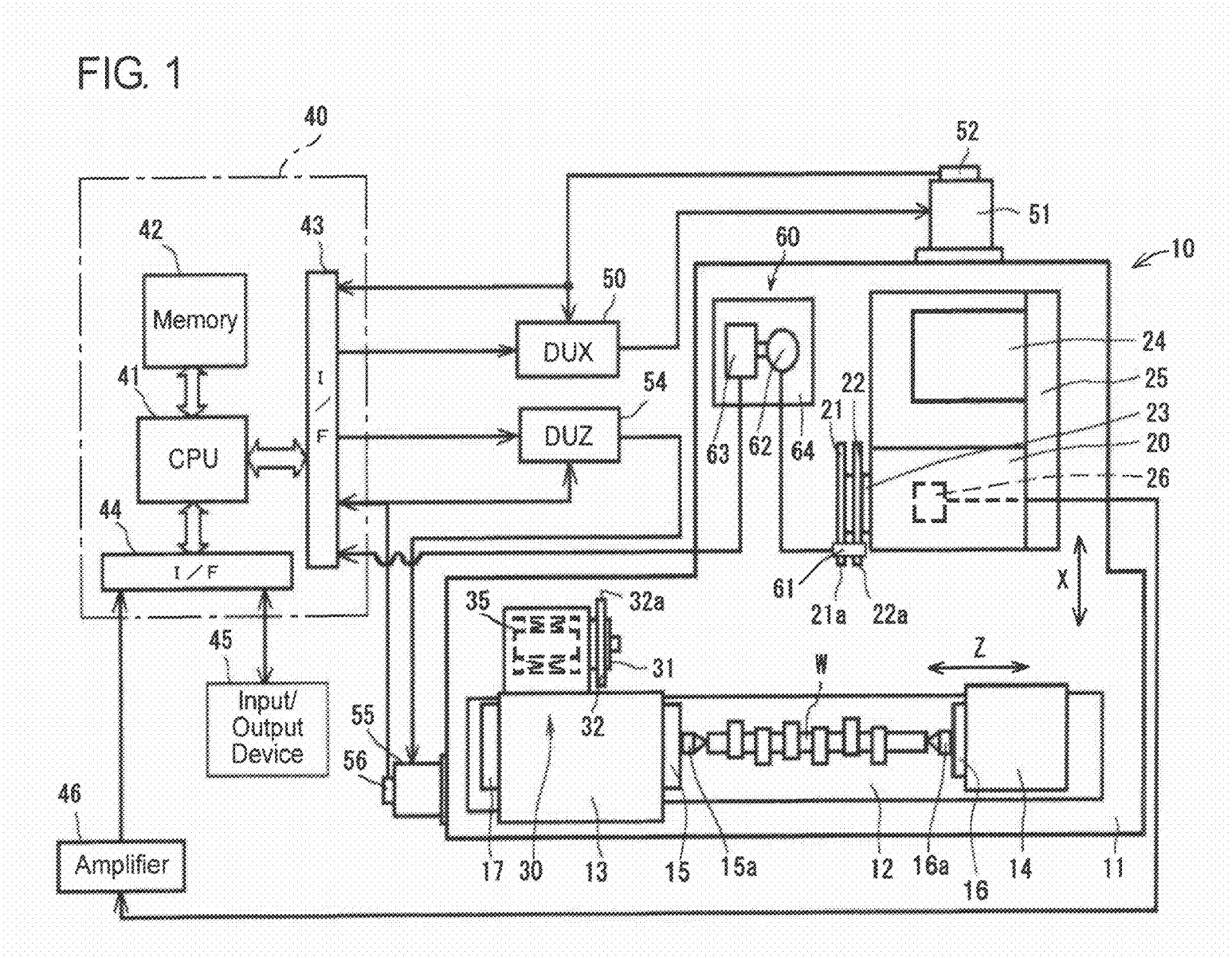
FIG. 1 is a schematic plan view of a grinding machine in a first embodiment according to the present invention.

Hereafter, embodiments according to the present invention will be described in detail with reference to the accompanying drawings. Referring now to FIG. 1, therein is shown a grinding machine 10 in a first embodiment. On a bed 11 of the grinding machine 10, a work table 12 is supported to be movably guided in a horizontal Z-axis direction, while a wheel head 20 is movably guided in a horizontal X-axis direction perpendicular to the Z-axis direction. Further, a coolant supply device 60 is mounted on the bed 11. On the work table 12, a work head 13 and a foot stock 14 which constitute a workpiece support and drive mechanism are arranged to face with each other. On the wheel head 20, a first grinding wheel 21 and a second grinding wheel 22 which are selectively used in dependence on the steps of grinding operations are supported to be rotatable about an axis parallel to the Z-axis direction.

The work head 13 rotatably carries therein a work spindle 15, which fits a center 15*a* in one end thereof for supporting one end of a workpiece W, while the foot stock 14 axially slidably receives therein a foot stock ram 16 which fits a center 16*a* in the other end thereof for supporting the other end of the workpiece W. Further, the work head 13 is provided with a work spindle drive motor 17 for rotating the work spindle 15 about an axis parallel to the Z-axis direction. The workpiece W is supported by the both centers 15*a*, 16*a* between the work spindle 15 and the foot stock ram 16 and is rotated by the work spindle drive motor 17 about its axis.

The first and second grinding wheels 21, 22 are attached to a wheel spindle 23 in a juxtaposed or side-by-side relation and is rotated by a wheel drive motor 24 mounted on the wheel head 20, through a belt transmission mechanism 25. Respective outer circumferential surfaces of the grinding wheels 21, 22 represent wide grinding surfaces 21*a*, 22*a* parallel to the Z-axis direction and grind portions on the workpiece W such as, for example, cams on a camshaft. Further, in or beside the wheel spindle 23, there is provided an AE (acoustic emission) sensor 26 for detecting an elastic wave which is generated upon contact of each of the first and second grinding wheels 21, 22 with the workpiece W or with a truing roll 32. The details of the first and second grinding wheels 21, 22 will be referred to later.

The coolant supply device 60 supplies coolant to a grinding point at which the first and second grinding wheels 21, 22 serve one at time to grind the workpiece W. The coolant supply device 60 is composed of a coolant nozzle 61, a pump 62, a motor 63, a coolant storage tank 64 and the like. Coolant supplied from the pump 62 driven by the motor 63 is controlled by a flow control valve (not shown) in supply quantity and cools and lubricates a portion being ground by being supplied to the grinding point from the coolant nozzle 61 attached over the first and second grinding wheels 21, 22. The coolant supplied to the grinding point flows under the bed 11 and, after separated by a magnetic separator or the like (not shown) from grinding chips, is returned again into the coolant storage tank 64.

The work head 13 is provided thereon with a truing device 30 for truing the first and second grinding wheels 21, 22. The truing device 30 is provided with the aforementioned truing roll 32 being thin in width which is attached to one end of a rotary truer spindle 31. A cylindrical truing surface 32*a* is formed on the outer circumferential surface of the truing roll 32. The truer spindle 31 is drivingly rotated by a built-in motor 35.

A numerical controller 40 for controlling the grinding machine 10 is primarily composed of a central processing unit 41, a memory 42 for storing various control values and programs, and interfaces 43, 44. The memory 42 stores various data such as grinding programs, truing programs and the like which are necessary for executing grinding cycles and truing cycles. Various data is inputted to the numerical controller 40 or is outputted therefrom through interfaces 43, 44. An input/output device 45 incorporates a keyboard for performing data input or the like and a display device such as CRT, LCD or the like for displaying data. Further, an AE signal from the AE sensor 26 is inputted to the numerical controller 40 through an amplifier 46.

The numerical controller 40 is configured to supply drive signals to an X-axis servomotor 51 for moving the wheel head 20 in the X-axis direction, through an X-axis motor drive unit 50. An encoder 52 attached to the X-axis servomotor 51 is configured to send the rotational position of the X-axis drive motor 51, that is, the position of the wheel head 20 to the X-axis motor drive unit 50 and the numerical controller 40. Further, the numerical controller 40 is also configured to supply drive signals to the Z-axis servomotor 55 for driving the work table 12 in the Z-axis direction, through a Z-axis motor drive unit 54. An encoder 56 attached to the Z-axis servomotor 55 is configured to send the rotational position of the Z-axis drive motor 55, that is, the position of the work table 12 to the Z-axis motor drive unit 54 and the numerical controller 40.

The numerical controller 40 drives the servomotors 51, 55 based on respective deviations between target position commands of an NC program stored in the memory 42 and respective present position signals from the encoders 52, 56 and controls the table 12 and the wheel head 20 to be positioned to the respective target positions. The numerical controller 40 counts the number of workpieces W ground with the first and second grinding wheels 21, 22 and instructs a truing operation when the number of the ground workpieces reaches a predetermined value.

In the grinding machine of the construction as described above, since the first grinding wheel 21 and the second grinding wheel 22 are juxtaposed on the wheel spindle 23 for selective use in dependence on the steps of grinding operations, it can be realized to perform the grinding with the first grinding wheel 21 and the grinding with the second grinding wheel 22 in succession or to complete all of the grindings with the second grinding wheel 22 following the completion of all of the grindings with the first grinding wheel 21, so that steps required for grinding operations can be decreased. Further, the first grinding wheel 21 and the second grinding wheel 22 are selectively used in dependence on the steps of grinding operations, wherein the second grinding wheel particularly has outstanding features described later, so that the enhancement in the accuracy of the grinding with the second grinding wheel 22 and the prolongment in the service life of the second grinding wheel 22 can be achieved though they have heretofore been difficult to coexist.

Figure 2:
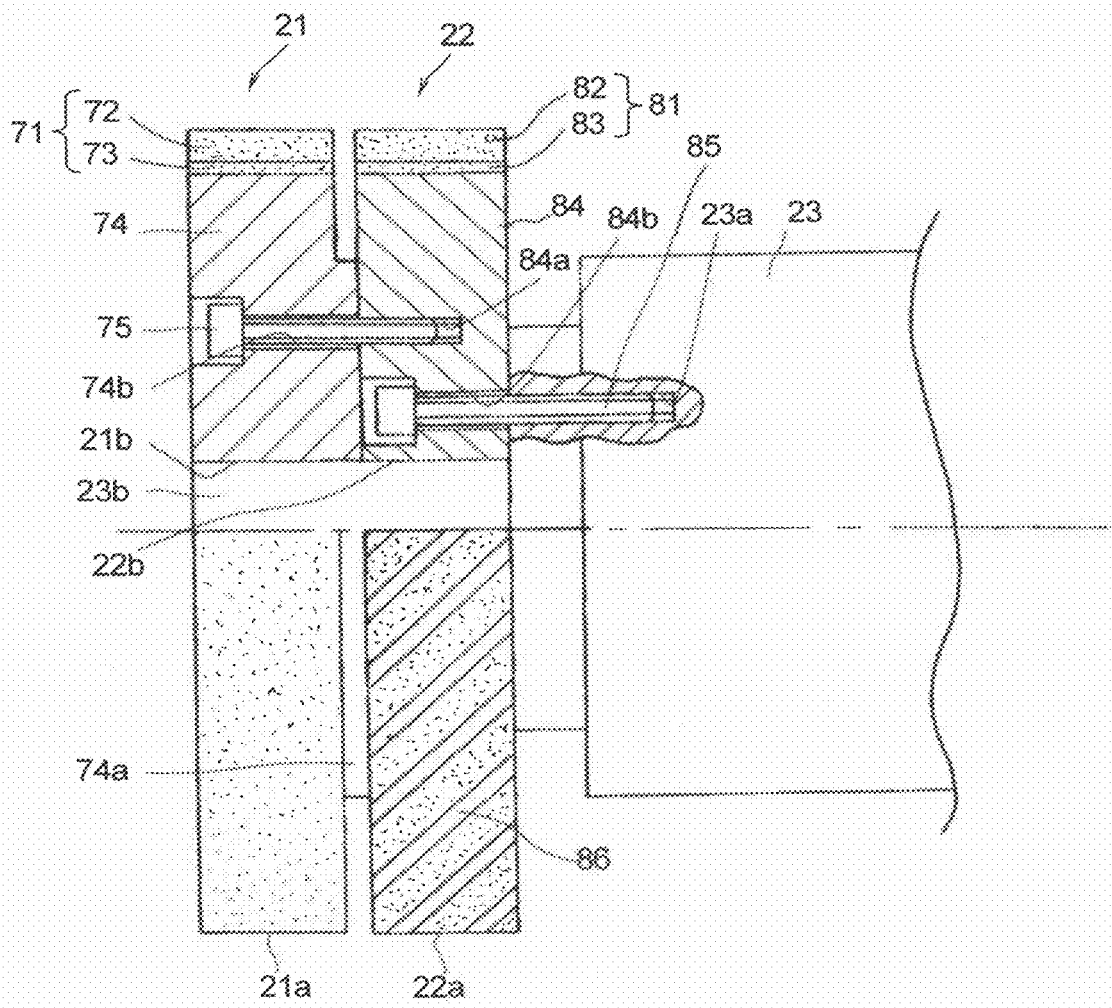
FIG. 2 is a front view showing, partly in section, first and second grinding wheels shown in FIG. 1 and a mounting mechanism therefor.

The first grinding wheel 21 is a grinding wheel with a grinding surface 21 a formed to be plane for use in rough grindings for example, while the second grinding wheel 22 is a grinding wheel with a plurality of oblique groove 86 (88, 89) on a grinding surface 22*a* for use in finish grindings for example. As shown in FIG. 2, the first and second grinding wheels 21, 22 are provided with segmented wheel chips 71, 81, respectively.

The wheel chips 71 of the first grinding wheel 21 are adjusted in concentration for use in rough grindings. Each of the wheel chips 71 includes an abrasive grain layer 72 which is formed on the side of outer circumference by bonding superabrasive grains such as, for example, CBN (cubic boron nitride), diamond or the like with a vitrified bond to the depth of 3 to 5 millimeters, and is bodily formed by placing on the inner side of the abrasive grain layer 72 a foundation layer 73 which is configured by bonding foundation particles with the vitrified bond to the depth of 1 to 3 millimeters.

The wheel chips 81 of the second grinding wheel 22 are adjusted to be close or dense in concentration for use in finish grindings. Each of the wheel chips 81 includes an abrasive grain layer 82 which is formed on the side of outer circumference by bonding superabrasive grains such as, for example, CBN, diamond or the like with a vitrified bond to the depth of 3 to 5 millimeters, and is bodily formed by placing on the inner side of the abrasive grain layer 82 a foundation layer 83 which is configured by bonding foundation particles with the vitrified bond to the depth of 1 to 3 millimeters. As described later in detail, the second grinding wheel 22 has a plurality of oblique grooves 86 formed on the grinding surface 22*a* thereof.

Because with the use of the vitrified bond, the property being porous improves the capability of discharging grinding chips thereby to enhance the sharpness, the grinding can be performed at an excellent accuracy of surface roughness and in a little quantity of the grinding wheel wear. However, as bond material, a resin bond, a metal bond or the like may be used instead of the vitrified bond.

Figure 3B:
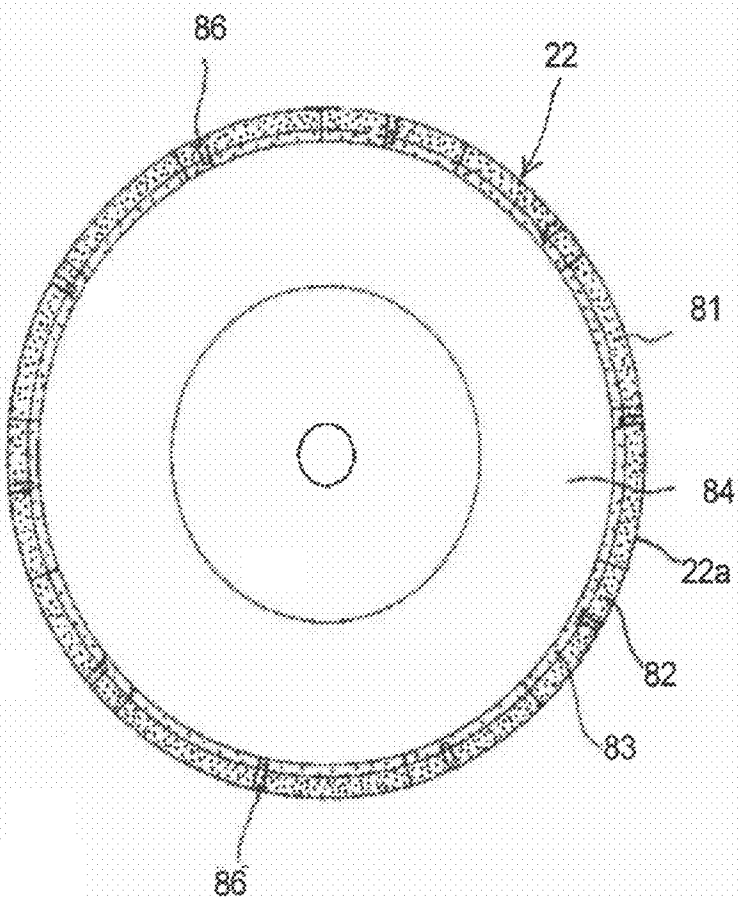
FIGS. 3(A) and 3(B) are side views of the first and second grinding wheels shown in FIG. 2, each composed of segmented wheel chips.
Figure 3A:
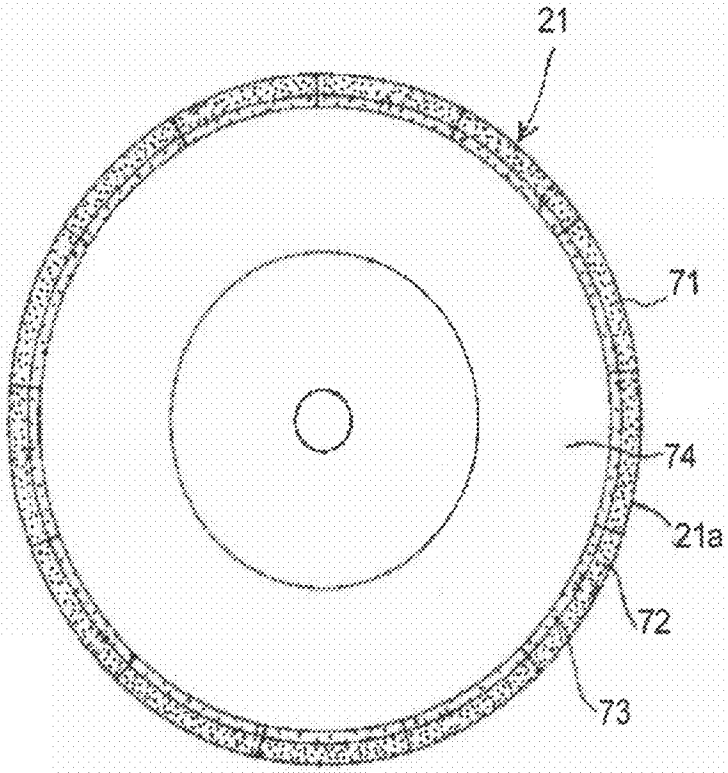

As shown in FIGS. 3(A) and 3(B), the first and second grinding wheels 21, 22 are configured so that pluralities of arc-shaped wheel chips 71, 81 respectively composed of the abrasive grain layers 72, 82 and the foundation layers 73, 83 are respectively arranged on outer circumferential surfaces of respective disc-like cores 74, 84 each made of a metal such as iron, aluminum or the like, a resin or the like and are adhered by an adhesive to the respectively cores 74, 84 at bottom surfaces of the foundation layers 73, 83.

As shown in FIG. 2, the core 74 of the first grinding wheel 21 protrudes a small-diameter flange portion 74*a* from the right end surface. The core 74 is drilled to have a plurality of bolt holes 74*b* which allow fastening bolts 75 to go through from the left end surface of the core 74 to the right end surface of the flange portion 74*a*. The left end of each bolt hole 74*b* is formed as an enlarged hole for receiving a head of each fastening bolt 75. The bolts holes 74*b* of the core 74 are provided at equiangular intervals.

As also shown in FIG. 2, a plurality of tapped or threaded holes 84*a* into which the fastening bolts 75 are respectively screwed are formed on the side of the left end surface of the core 84 of the second grinding wheel 22. The threaded holes 84*a* are formed at equiangular intervals in correspondence to the bolt holes 74*b*. The core 84 is drilled to have a plurality of bolt holes 84*b* which allow fastening bolts 85 to go through from the left end surface to the right end surface thereof. The left end of each bolt hole 84*b* is formed as an enlarged hole for receiving a head of each fastening bolt 85. The bolts holes 84*b* are provided to pass through the core 84 at equiangular intervals on a bolt circle which is inside a bolt circle for the threaded holes 84*a*. Further, a plurality of threaded holes 23*a* open on a left end surface of the wheel spindle 23 for enabling the fastening bolts 85 to be screw-engaged thereinto, respectively. The threaded holes 23*a* are formed at the left end surface at equiangular intervals in correspondence to the bolt holes 84*b*.

In fastening the first and second grinding wheels 21, 22 on the wheel spindle 23, first of all, the second grinding wheel 22 is fitted at its center hole 22*b* on a small-diameter centering shaft portion 23*b* of the wheel spindle 23 and is brought into close contact at the right end surface with the left end surface of the wheel spindle 23. Then, the fastening bolts 85 are inserted into the bolt holes 84*b* and are screw-engaged with the threaded holes 23*a* of the wheel spindle 23, respectively. Thus, the second grinding wheel 22 is centered on the wheel spindle 23 and is securely fixed thereto. Thereafter, the first grinding wheel 21 is fitted at its center hole 21*b* on the centering shaft portion 23*b* of the wheel spindle 23 and is brought into close contact at the right end surface of the flange portion 74*a* with the left end surface of the second grinding wheel 22. Then, the fastening bolts 75 are inserted into the bolt holes 74*b* and are screw-engaged with the threaded holes 84*a* of the second grinding wheel 22, respectively. As a result, the first grinding wheel 21 is securely fixed on the second grinding wheel 22 with itself centered on the wheel spindle 23. By using the fastening bolts 75, 85 as described above, the first grinding wheel 21 is detachable from the second grinding wheel 22, which is then detachable from the wheel spindle 23. Any other means for detachably fastening the grinding wheels 21, 22 can be used without being limited to the bolts.

With the construction as described above, since the first grinding wheel 21 for rough grindings are shorter in service life than the second grinding wheel 22 for finish grindings, the first grinding wheel 21 only can be detached from the wheel spindle 23 to be replaced with a fresh first grinding wheel 21 having been prepared in advance. This is because as described above, the first grinding wheel 21 is securely fixed on the second grinding wheel 22, while the second grinding wheel 22 is securely fixed on the wheel spindle 23. Therefore, the man hour for replacing grinding wheels can be reduced to the extent that the work for detaching the second grinding wheel 22 becomes unnecessary for replacement of the first grinding wheel 21. Moreover, since the first grinding wheel 21 only can be replaced when it reaches the end of service life, the cost for grinding wheels can be reduced in comparison with a construction in which grinding wheels for rough and finish grindings have to be replaced at a time even when one only of the grinding wheels reaches the end of service life.

Further, an axial space or clearance corresponding to the thickness of the flange portion 74*a* is provided between the grinding surface 21*a* of the first grinding wheel 21 and the grinding surface 22*a* of the second grinding wheel 22. Thus, after truing the grinding surface 21*a* of the first grinding wheel 21 through a traverse movement, the truing roll 32 can once be let go to the clearance. Then, the grinding surface 22*a* of the second grinding wheel 22 can be trued in succession with the truing roll 32. Thus, it is unnecessary to return either one or both of the truing device 30 and the wheel head 20 to home positions thereof, so that steps taken for truing can be decreased. Since the width of the truing roll 32 is usually one millimeter or so, the clearance between the grinding surface 21*a* and the grinding surface 22*a* is set preferably to more than one millimeter.

Further, the second grinding wheel 22 will be described in detail. As shown in FIGS. 4 to 7(C), the grinding surface 22*a* of the second grinding wheel 22 is provided thereon with the plurality of oblique grooves 86, which enter one side and come out the other side of both end surfaces 82*a*, 82*b* parallel to the wheel circumferential direction of the abrasive grain layer 82 at a depth h from the grinding surface 22*a* to reach the foundation layer 83. That is, on the grinding surface 22*a*, the plurality of oblique grooves 86 which are inclined by a predetermined inclination angle α relative to the wheel circumferential direction are formed at equiangular intervals of a predetermined pitch P. The arrangement of the plurality of oblique grooves 86 are such that where one side intersection point Ca is defined as an intersection point of each oblique groove 86 and an extension line L1 of one side edge Sa parallel to the wheel circumferential direction of the contact surface S and the other side intersection point Cb is defined as an intersection point of each oblique groove 86 and an extension line L2 of the other side edge Sb, the other side intersection point Cb of each oblique groove 86 overlaps the one side intersection point Ca of an oblique groove 86 next to each such oblique groove 86 by an overlap amount V in the wheel circumferential direction. In other words, the plurality of oblique grooves 86 inclined by the predetermined angle α are formed on the grinding surface 22*a* at the equiangular intervals to open at both sides of the second grinding wheel 22 so that a part of each oblique groove 86 on one side of the second grinding wheel 22 overlaps a part of a circumferentially adjoining oblique groove 86 (i.e., an oblique groove 86 next to each such oblique groove 86) on the other side of the second grinding wheel 22 by the predetermined overlap amount V in the wheel circumferential direction.

In addition, the infeed amount t of the grinding wheel 22 against the workpiece W and at least one of the inclination angle α and the interval (pitch) P of the oblique grooves 86 are set so that the length L in the wheel circumferential direction of the contact surface S on the grinding surface 22*a* of the second grinding wheel 22 and the workpiece W becomes shorter than the overlap amount V. The contact surface S is an area on the grinding surface 22*a* of the second grinding wheel 22 which area is partitioned by the intersection points at which the outer circle of the second grinding wheel 22 crosses the outer circle of the workpiece W, and the width A of the workpiece W. The contact surface S is surrounded by the one side edge Sa and the other side edge Sb which extend in parallel to the wheel circumferential direction, and one side edge Sf and the other side edge Sr which extend in parallel to the grinding wheel axis.

Since the length L in the wheel circumferential direction of the contact surface S on the grinding surface 22*a* of the second grinding wheel 22 and the workpiece W is made to be shorter than the overlap amount V, coolant supplied from the upside onto the contact surface S flows out from the upper and lower sides through the oblique grooves 86 crossing the contact surface S, whereby a dynamic pressure in coolant generated between the grinding surface 22*a* and the workpiece W can be released. Thus, it can be prevented that the dynamic pressure in coolant causes the workpiece W to be displaced in a direction to go away from the second grinding wheel 22 or the distance which the workpiece W goes away from the second grinding wheel 22 varies upon fluctuations in the dynamic pressure generated in the coolant. As a result, it becomes possible to enhance the accuracy of the ground workpiece W.

Figure 4:
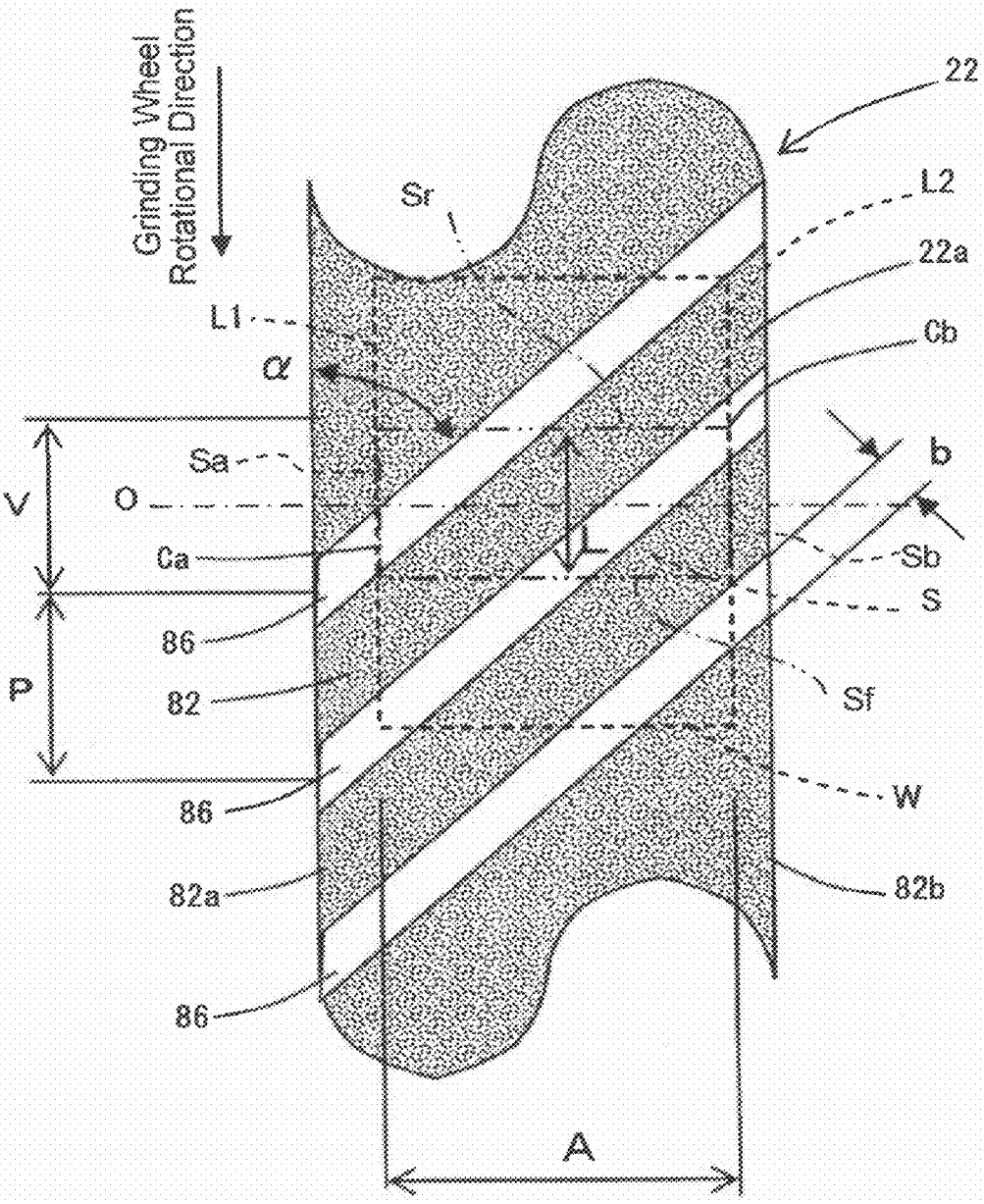
FIG. 4 is an expansion view showing the grinding surface of the second grinding wheel shown in FIG. 3, in the form of an expansion.
Figure 5:
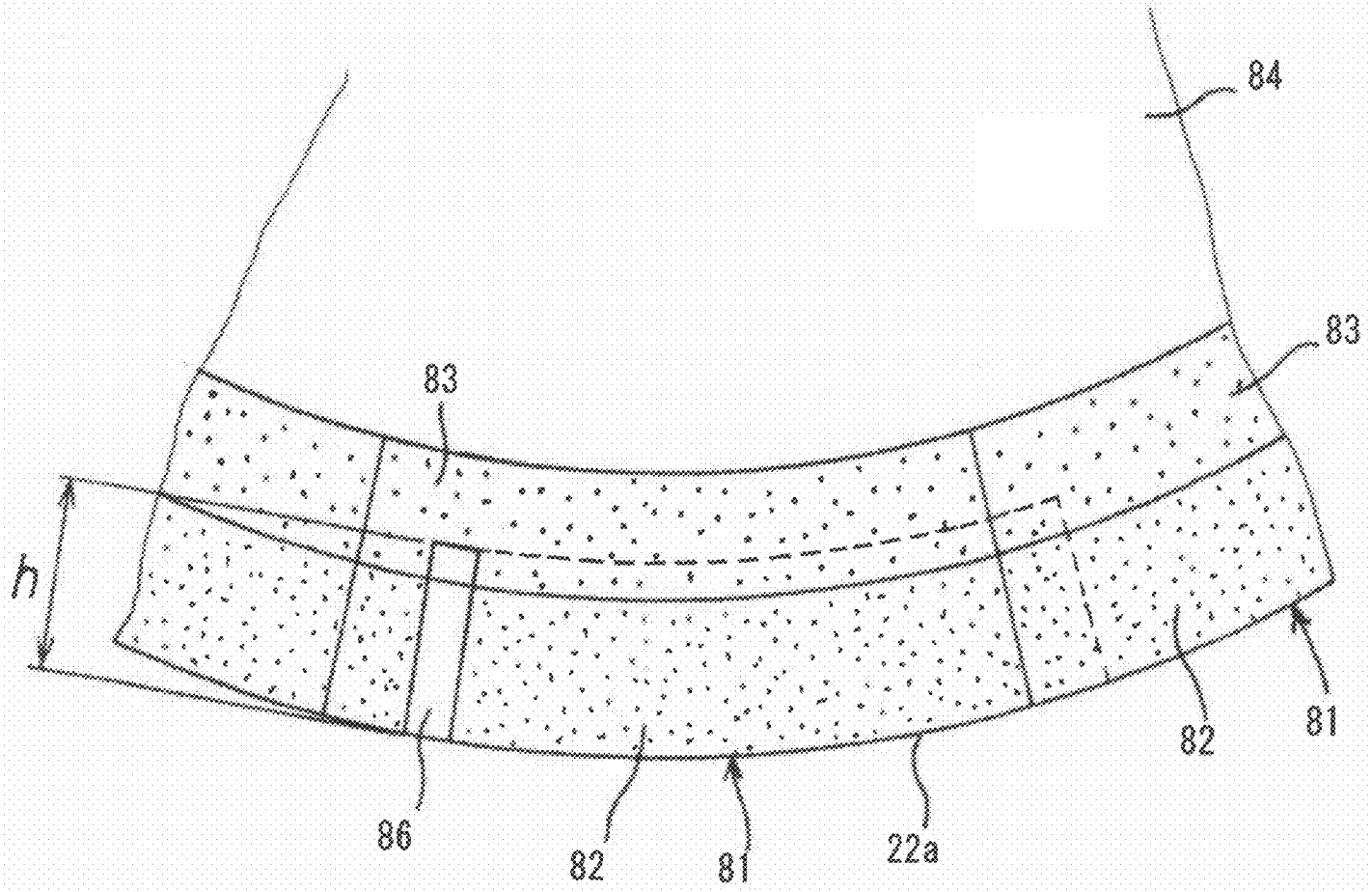
FIG. 5 is a fragmentary side view showing the state that oblique grooves are formed on an abrasive grain layer of the second grinding wheel shown in FIG. 3.
Figure 6:
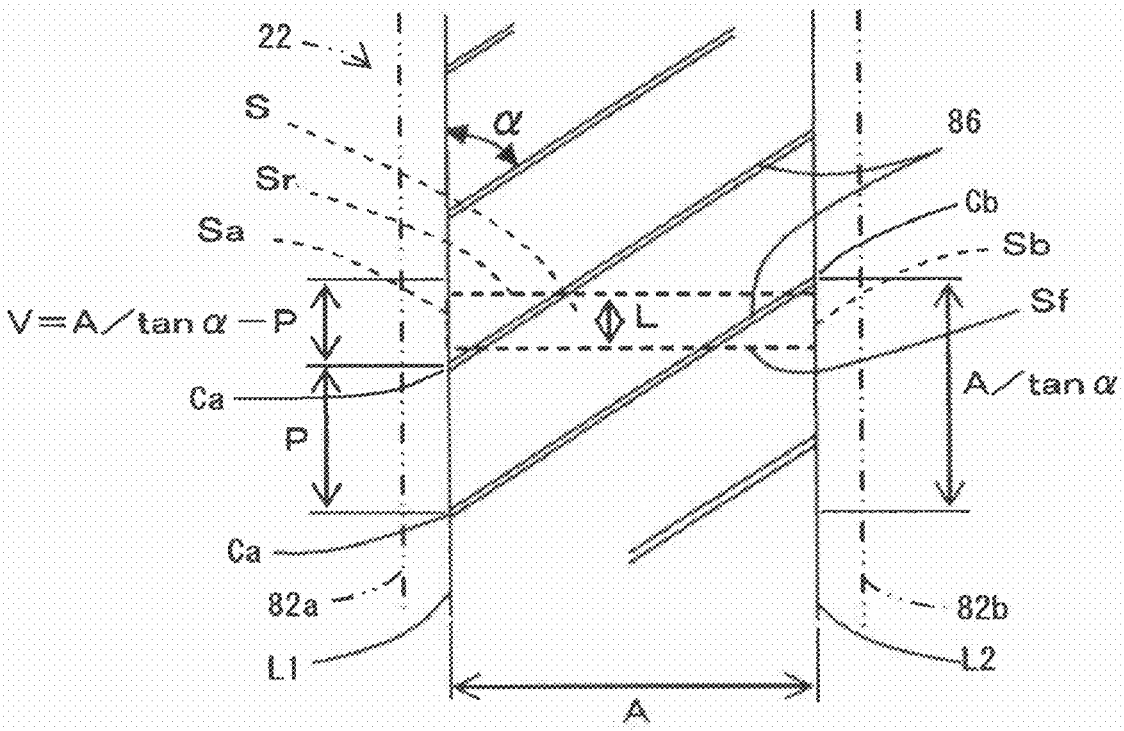
FIG. 6 is an illustration showing the relations between an overlap amount, an inclination angle $\alpha$ and a pitch P in the circumferential direction of the oblique grooves and an axial length A of a contact surface S.

As is clear from FIGS. 4 and 6 showing the grinding surface 22*a* of the second grinding wheel 22 in a developed form, the following relation holds between the overlap amount V by which the other side intersection point Cb at which each oblique groove 86 crosses the extension line L2 of the other side edge Sb of the contact surface S overlaps the one side intersection point Ca at which an oblique groove 86 next to each such oblique groove 86 crosses the extension line L1 of one side edge Sa of the contact surface S, the inclination angle α of the oblique grooves 86, the interval P of the adjoining oblique grooves 86, e.g., the pitch in the circumferential direction, and the width A of the workpiece W represented by the axial length of the contact surface S.

$$V=A/\tan\alpha-P \quad (1)$$

Therefore, where the following condition in which the length L in the circumferential direction of the contact surface S is shorter than the overlap amount V is satisfied, $$L<A/\tan\alpha-P \quad (2)$$

it can be realized that at least one oblique groove 86 vertically passes through the contact surface S independently of the rotational phase of the second grinding wheel 22. As a result, it becomes possible to release the dynamic pressure which the coolant flowing onto the contact surface S generates between the grinding surface 22*a* and the workpiece W, from both of the upper and lower sides of the contact surface S. Where the condition is not satisfied, on the contrary, it takes place in dependence on the rotational phase of the second grinding wheel 22 that none of the oblique grooves 86 vertically passes through the contact surface S. That is, when the oblique groove 86 opens only on the upper side of the contact surface S, the dynamic pressure cannot be released on the lower side of the contact surface S. Likewise, when the oblique groove 86 opens only on the lower side of the contact surface S, the dynamic pressure in the coolant cannot be released on the upper side of the contact surface S.

Figure 7A:
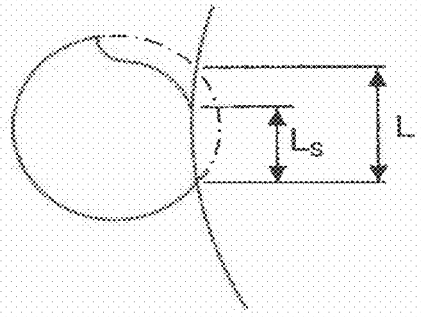
FIGS. 7(A)-7(C) are illustrations showing the length in the circumferential direction of the contact surface on the second grinding wheel shown in FIG. 3.
Figure 7B:
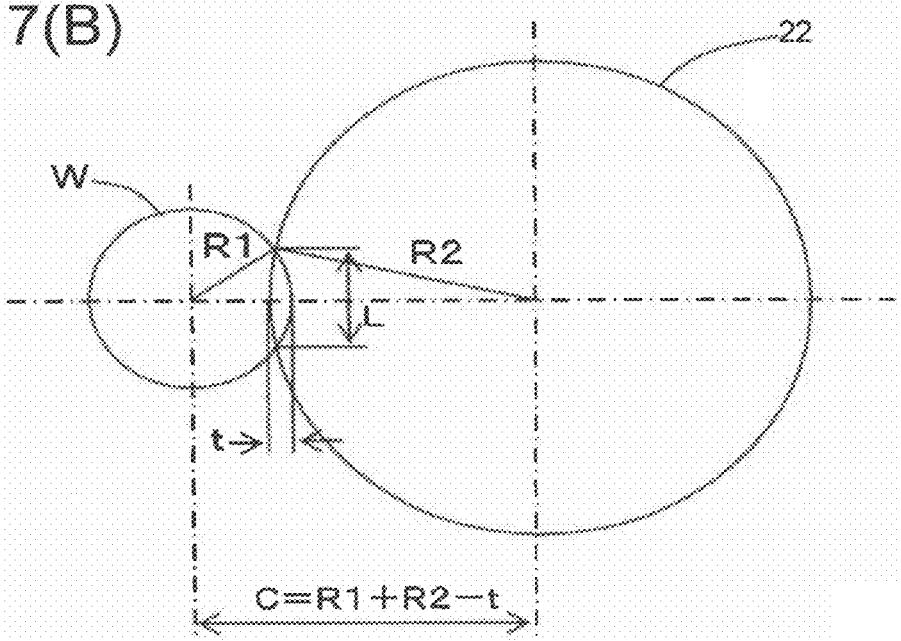
Figure 7C:
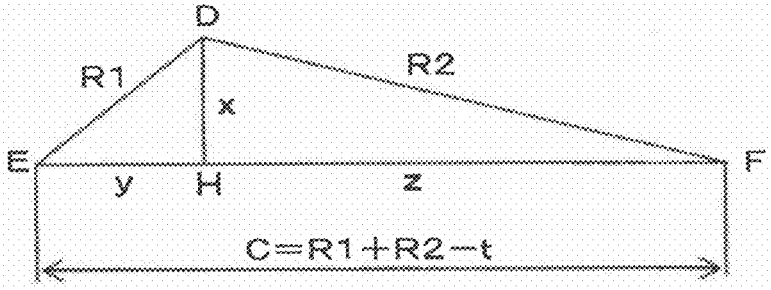

As shown in FIG. 7(B), the length L in the wheel circumferential direction of the contact surface S on which the second grinding wheel 22 contacts the workpiece W is taken as the length of a line segment connecting intersection points at each of which the outer circle of the second grinding wheel 22 crosses the outer circle of the workpiece W. Since the length L in the wheel circumferential direction of the contact surface S is extremely short in comparison with the diameters of the second grinding wheel 22 and the workpiece W, it can be approximated by the length of the line segment connecting the intersection points at each of which the outer circle of the second grinding wheel 22 crosses the outer circle of the workpiece W.

Taking the radius of the workpiece W as R1, the radius of the second grinding wheel 22 as R2 and the infeed amount of the second grinding wheel 22 against the workpiece W as t, as shown in FIG. 7(*c*), the center-to-center distance C between the workpiece W and the second grinding wheel 22 is expressed as follows.

$$C=R1+R2-t \tag{3}$$

Taking as D the intersection point at which the outer circle of the second grinding wheel 22 crosses the outer circle of the workpiece W, as EF a line segment connecting the center E of the workpiece W with the center F of the second grinding wheel 22 and as H a point at which a line segment coming from the intersection point D downward to line segment EF crosses the line segment EF at the right angle, and further taking the lengths of the line segments DH, EH and FH respectively as x, y and z, the following relations hold.

$$R1^2=x^2+y^2 \tag{4}$$

$$R2^2=x^2+z^2 \tag{5}$$

$$\text{Since } C=y+z\text{, then there holds } y^2=(C-z)^2 \tag{6}$$

Solving the expressions (4), (5) and (6) for x, there holds:

$$x=\sqrt{(R2^2-((C^2+R2^2-R1^2)/2C)^2)} \tag{7}$$

Then, the length L in the circumferential direction of the contact surface S on which the second grinding wheel 22 contacts the workpiece W is:

$$L=2x \tag{8}$$

Where the length L in the circumferential direction of the contact surface S is equal to the overlap amount V, there comes $L=2x=V=A/\tan\alpha-P$ from the expressions (1) and (8), and the infeed amount t0 in this case becomes:

$$t0=R1+R2-\sqrt{(R1^2-((A/\tan\alpha-P)/2)^2)}-\sqrt{(R2^2-((A/\tan\alpha-P)/2)^2)} \tag{9}$$

Therefore, where determinations have been made regarding the radii R1, R2 of the workpiece W and the second grinding wheel 22, the width A of the workpiece W and the inclination angle α and the pitch P in the circumferential direction of the oblique grooves 86, the length L in the circumferential direction of the contact surface S becomes shorter than the overlap amount V by setting the infeed amount t of the second grinding wheel 22 against the workpiece W to be smaller than t0.

Further, where determinations have been made regarding the radii R1, R2 of the workpiece W and the second grinding wheel 22, the width A of the workpiece W, the infeed amount t of the second grinding wheel 22 against the workpiece W and one of the inclination angle α and the pitch P in the circumferential direction of the oblique grooves 86, the length L in the circumferential direction of the contact surface S becomes shorter than the overlap amount V by setting the other of the inclination angle α0 and the pitch P0 in the circumferential direction of the oblique grooves 86 as the expression (9) holds, and by setting the pitch P in the circumferential direction or the inclination angle α to be smaller than the pitch P0 in the circumferential direction or the inclination angle α0 which is so set. The number n of the oblique grooves 86 set in this way becomes $n=2\pi\times R2/P$.

The foregoing embodiment is exemplified as the case that the width of the workpiece W is narrower than the width of the second grinding wheel 22, in which case the specifications of the oblique grooves 86 are determined on the assumption that the axial length of the contact surface S is equal to the width A of the workpiece W. However, in the case that the width A of the workpiece W is wider than the width of the second grinding wheel 22, the specifications of the oblique grooves 86 may be determined on the assumption that the axial length of the contact surface S is equal to the width of the grinding wheel 22. Further, in the foregoing embodiment, the length L in the wheel circumferential direction of the contact surface S is approximated by the length of the line segment connecting the intersection points at which the outer circle of the second grinding wheel 22 crosses the outer circle of the workpiece W. However, when the workpiece W is being drivingly rotated with the second grinding wheel 22 infed by an infeed amount t against the workpiece W, strictly speaking, the infeed of the second grinding wheel 22 against the workpiece W changes the actual length in the wheel circumferential direction of the contact surface S to Ls, as shown in FIG. 7(*a*), and therefore, the length in the wheel circumferential direction of the contact surface S may be determined as $Ls<L=A/\tan\alpha-P$.

In short, in grinding the workpiece W with the second grinding wheel 22 under the control of the numerical controller 40, the grinding is performed after the infeed amount t of the second grinding wheel 22 against the workpiece W and at least one of the inclination angle α and the pitch (interval) P in the wheel circumferential direction are set so that the length L in the wheel circumferential direction of the contact surface S on the grinding surface 22*a* of the second grinding wheel 22 and the workpiece W becomes shorter than the overlap amount V. As a consequence, without decreasing the supply quantity of coolant, it can be prevented that the dynamic pressure in coolant causes the workpiece W to be displaced in a direction to go away from the second grinding wheel 22 or the distance which the workpiece W goes away from the second grinding wheel 22 varies upon fluctuations in the dynamic pressure generated in the coolant, and as a result, it becomes possible to enhance the machining accuracy in the grinding of the workpiece with the second grinding wheel 22. Additionally, since the first grinding wheel 21 is used at the grinding step where the use of the second grinding wheel 22 could result in shortening the service life of the second grinding wheel 22, it can be realized to prolong the service life of the second grinding wheel 22.

Figure 8:
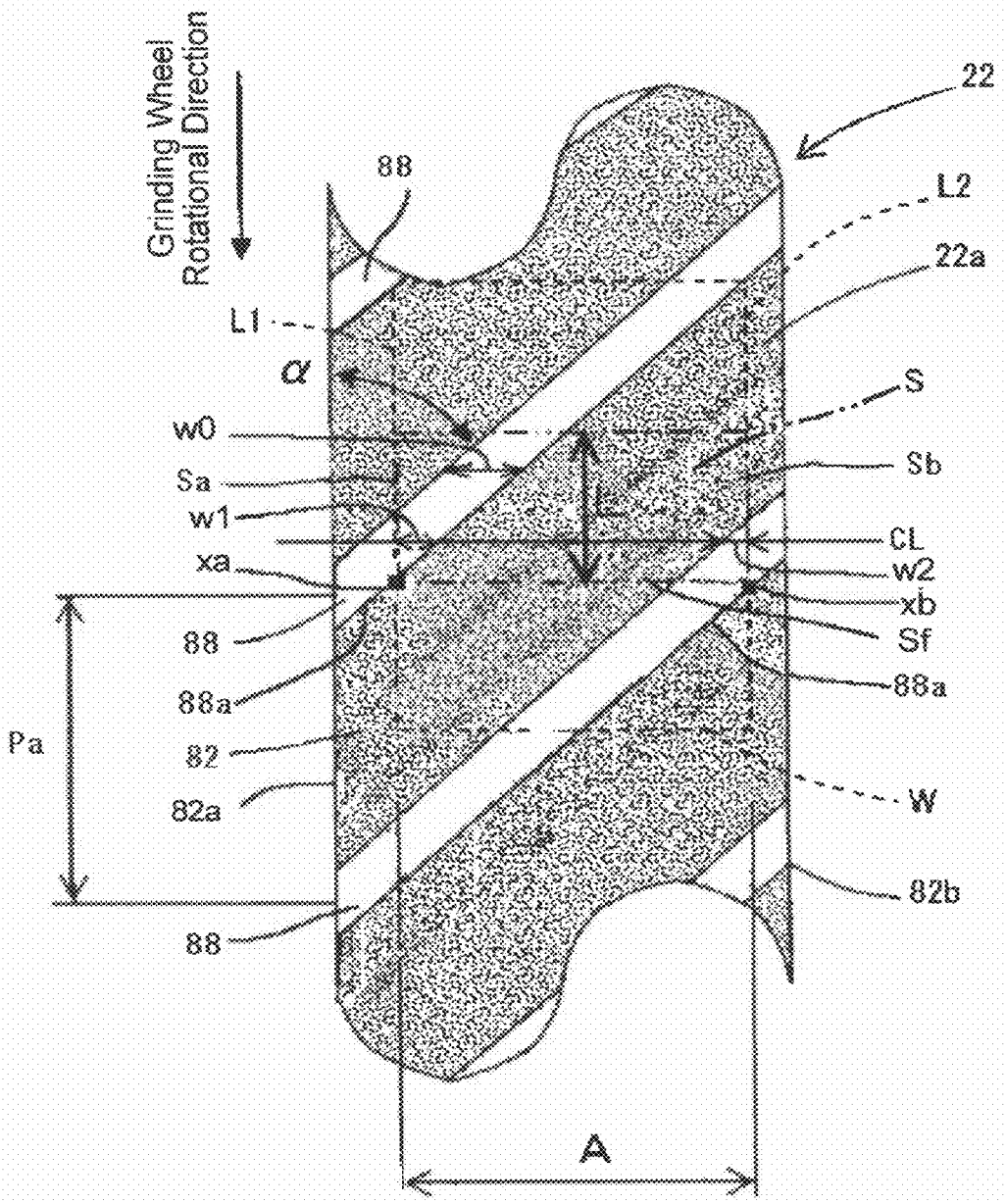
FIG. 8 is an expansion view showing the state that oblique grooves in a modified form are formed on the abrasive grain layer of the second grinding wheel shown in FIG. 3.

FIG. 8 shows oblique grooves 88 in a modified form which are provided on the second grinding wheel 22, in correspondence to FIG. 4. Detailed description of the second grinding wheel 22 in this modified form will be omitted by denoting the same components by the same reference numerals. On the grinding surface 22*a* of the second grinding wheel 22, a plurality of oblique grooves 88 which are inclined by a predetermined inclination angle α relative to the wheel circumferential direction are grooved on an abrasive grain layer 82 to enter one side and to come out the other side of both end surfaces 82*a*, 82*b* parallel to the wheel circumferential direction at a depth h (same in h as the oblique grooves 86 shown in FIG. 5) from the grinding surface 22*a* to reach the foundation layer 83. The oblique grooves 88 in the modified form are same in the aforementioned respects as the oblique grooves 86 shown in FIG. 4 or the like, but are different therefrom in the following respects.

The oblique grooves 88 are grooved at equiangular intervals of a predetermined pitch Pa in such an arrangement that the sum of widths w1 and w2 of two adjoining oblique grooves 88 which are within the contact surface S on the grinding surface 22*a* of the second grinding wheel 22 and the workpiece W and which exist on a cutting-plane line CL becomes constant, that is, becomes equal to the width w0 (=w1+w2) of a single oblique groove 88 at all times, wherein the cutting-plane line CL is taken when radially cutting the second grinding wheel 22 at an arbitrary position in the circumferential direction in parallel to the axis of the wheel spindle 23. The width of the oblique groove 88 existing on the cutting-plane line CL may be defined to be replaced by the area of the oblique groove 88 existing within the contact surface S.

In other words, each oblique groove 88 is grooved in such an arrangement that where an one-side edge portion 88*a* of one oblique groove 88 is located at an intersection xa of an one-side edge Sa parallel to the wheel circumferential direction and an one-side edge Sf parallel to the grinding wheel axis, a one-side edge portion 88*a* of an oblique groove 88 adjoining the one oblique groove 88 is located at an intersection xb of the other-side edge Sb parallel to the wheel circumferential direction and the one-side edge Sf parallel to the grinding wheel axis.

Here, the effect of the oblique grooves 88 in reducing the dynamic pressure generated in coolant is proportional to the width w0(=w1+w2) of the oblique groove 88. Therefore, it can be realized to make the dynamic pressure reduction effect constant over the whole circumference of the grinding surface 22*a* by grooving the oblique grooves 88 so that as described above, the width w0(=w1+w2) of the oblique groove 88 becomes constant over the whole circumferential surface of the grinding surface 22*a* of the second grinding wheel 22. As a result, it becomes possible to grind the workpiece W without nonuniformity thereon. Further, coolant supplied from the upside onto the contact surface S flows out from the upper and lower sides through the oblique grooves 88 crossing the contact surface S, whereby a dynamic pressure in coolant generated between the grinding surface 22*a* and the workpiece W can be released. Thus, it can be prevented that the dynamic pressure in coolant causes the workpiece W to be displaced in a direction to go away from the second grinding wheel 22 or the distance which the workpiece W goes away from the second grinding wheel 22 varies upon fluctuations in the dynamic pressure generated in the coolant. As a result, it becomes possible to enhance the accuracy of the ground workpiece W.

Figure 9:
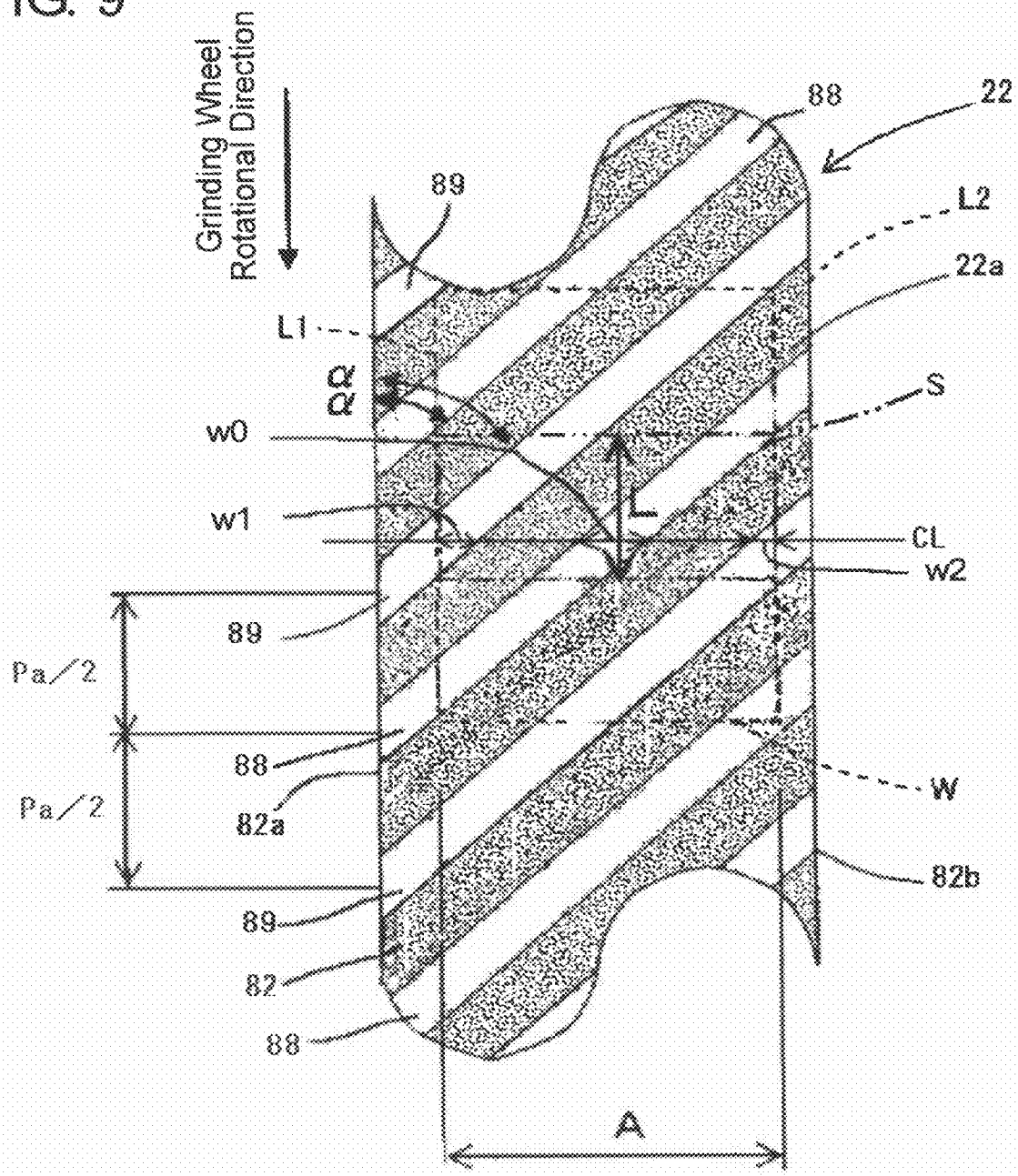
FIG. 9 is an expansion view showing the state that oblique grooves in a further modified form are formed on the abrasive grain layer of the second grinding wheel shown in FIG. 3.

FIG. 9 shows oblique grooves 88, 89 in a further modified form which are provided on the second grinding wheel 22, in correspondence to FIG. 8. Detailed description of the second grinding wheel 22 in this further modified form will be omitted by denoting the same portions by the same reference numerals. On the grinding surface 22*a* of the second grinding wheel 22, a plurality of similar oblique grooves 89 are grooved each at a mid portion between each oblique groove 88 and an adjoining oblique groove 88 shown in FIG. 8. That is, the plurality of oblique groove 89 which are inclined by the predetermined inclination angle $\alpha$ relative to the wheel circumferential direction are grooved on the abrasive grain layer 82 to enter one side and to come out the other side of the both end surfaces 82*a*, 82*b* of the abrasive grain layer 82 parallel to the wheel circumferential direction at a depth h (same in h as the oblique grooves 86 shown in FIG. 5) from the grinding surface 22*a* to reach the foundation layer 83. That is, each oblique groove 88 and an adjoining oblique groove 89 are grooved at equiangular intervals of a pitch being Pa/2.

By adding the oblique grooves 89, grooving is made on the grinding surface 22*a* of the second grinding wheel 22 in such an arrangement that the sum of a width w0 of an oblique groove 88 and widths w1 and w2 of an oblique groove 89 which are within the contact surface S on the grinding surface 22*a* of the second grinding wheel 22 and the workpiece W and which exist on a cutting-plane line CL becomes constant at all times, that is, becomes the sum of the width w0 of one oblique groove 88 and the width w0 of one oblique groove 89, wherein the cutting-plane line CL is taken when radially cutting the second grinding wheel 22 at an arbitrary position in the circumferential direction in parallel to the axis of the wheel spindle 23. The widths of the oblique groove 88 and the oblique groove 89 which exist on the cutting-plane line CL may be defined to be replaced by the total area of the oblique groove 88 and the oblique groove 89 which exist within the contact surface S.

It can be realized to make the dynamic pressure reduction effect constant over the whole circumference of the grinding surface 22*a* by grooving the oblique grooves 88, 89 so that as described above, the width 2w0(=w0+w1+w2) of the oblique grooves 88, 89 becomes constant over the whole circumferential surface of the grinding surface 22*a* of the second grinding wheel 22. As a result, it becomes possible to grind the workpieces W without nonuniformity thereon. Further, because coolant supplied from the upside onto the contact surface S flows out from the upper and lower sides through the oblique grooves 88, 89 crossing the contact surface S, the outflow volume can be increased, whereby a dynamic pressure in coolant generated between the grinding surface 22*a* and the workpiece W can be released further efficiently. Thus, it can be prevented that the dynamic pressure in coolant causes the workpiece W to be displaced in a direction to go away from the second grinding wheel 22 or the distance which the workpiece W goes away from the second grinding wheel 22 varies upon fluctuations in the dynamic pressure generated in the coolant. As a result, it becomes possible to enhance the accuracy of the ground workpiece W. It is to be noted that the width of the oblique grooves 89 so added may be varied from the width of the original oblique grooves 88. It is further to be noted that two or more oblique grooves 89 may be added between every adjoining oblique grooves 88. The oblique grooves 89 to be added in this modified case should be grooved to be same in the width, the inclination angle and the pitch for achievement of the aforementioned effects. It is further to be noted that it does not matter for the examples respectively shown in FIGS. 8, 9 not to satisfy the relation L<V as explained in the example of FIG. 4. That is, it is only required there that the sum of the groove widths is made to be uniform.

Regarding the aforementioned arrangements of the oblique grooves 86, 88, 89 shown in FIGS. 4, 8 and 9, the arrangement of the oblique grooves 88, 89 shown in FIG. 8 or 9 is most preferable because it can make the dynamic pressure reduction effect constant over the whole outer circumferential surface of the abrasive grain layer 82 to grind the workpiece W without ununiformity thereon, and also because it can effectively release a dynamic pressure generated in the coolant between the outer circumferential surface of the abrasive grain layer 82 and the workpiece W to enhance the grinding accuracy of the ground workpiece W. The arrangement of the oblique grooves 86 shown in FIG. 4 is second preferable because it can effectively release a dynamic pressure generated in the coolant between the outer circumferential surface of the abrasive grain layer 82 and the workpiece W to enhance the grinding accuracy of the ground workpiece W. However, the present invention is not limited to these arrangements and shapes of the oblique grooves 86, 88, 89. Instead, oblique grooves of a different arrangement or shape may be formed on the grinding surface 22*a* of the second grinding wheel 22, in which case, it also becomes possible to effectively release a dynamic pressure generated in the coolant between the grinding surface 22*a* and the workpiece W, so that the grinding accuracy of the ground workpiece W can be enhanced.

In the foregoing first embodiment, the grinding machine 10 has been described as a single head grinding machine in which the wheel head 20 supports the first grinding wheel 21 and the second grinding wheel 22 on the wheel spindle 23 in a juxtapose relation in a cantilever fashion. Alternatively, for example, where the first and second grinding wheels 21, 22 are attached respectively to the respective wheel spindles of a twin-head grinding machine in a second embodiment shown in FIG. 10 or to the respective wheel spindles of a grinding machine with a swivel device in a third embodiment shown in FIG. 11, the first and second grinding wheels 21, 22 are provided on one grinding machine, in which a grinding operation with the first grinding wheel 21 and a grinding operation with the second grinding wheel 22 can be performed in succession, so that it becomes possible to decrease the steps which are required to successively perform grinding operations with the first and second grinding wheels 21, 22. Further, because the second grinding wheel 22 has the aforementioned outstanding features, it becomes possible to realize the enhancement in accuracy of the grinding using the second grinding wheel 22 and the prolongment of the service life of the second grinding wheel 22 which have been difficult to coexist in the prior art grinding machine. Hereafter, the twin-head grinding machine will be described with reference to FIG. 10, and then, the grinding machine with the swivel device will be described with reference to FIG. 11.

(Second Embodiment)

Figure 10:
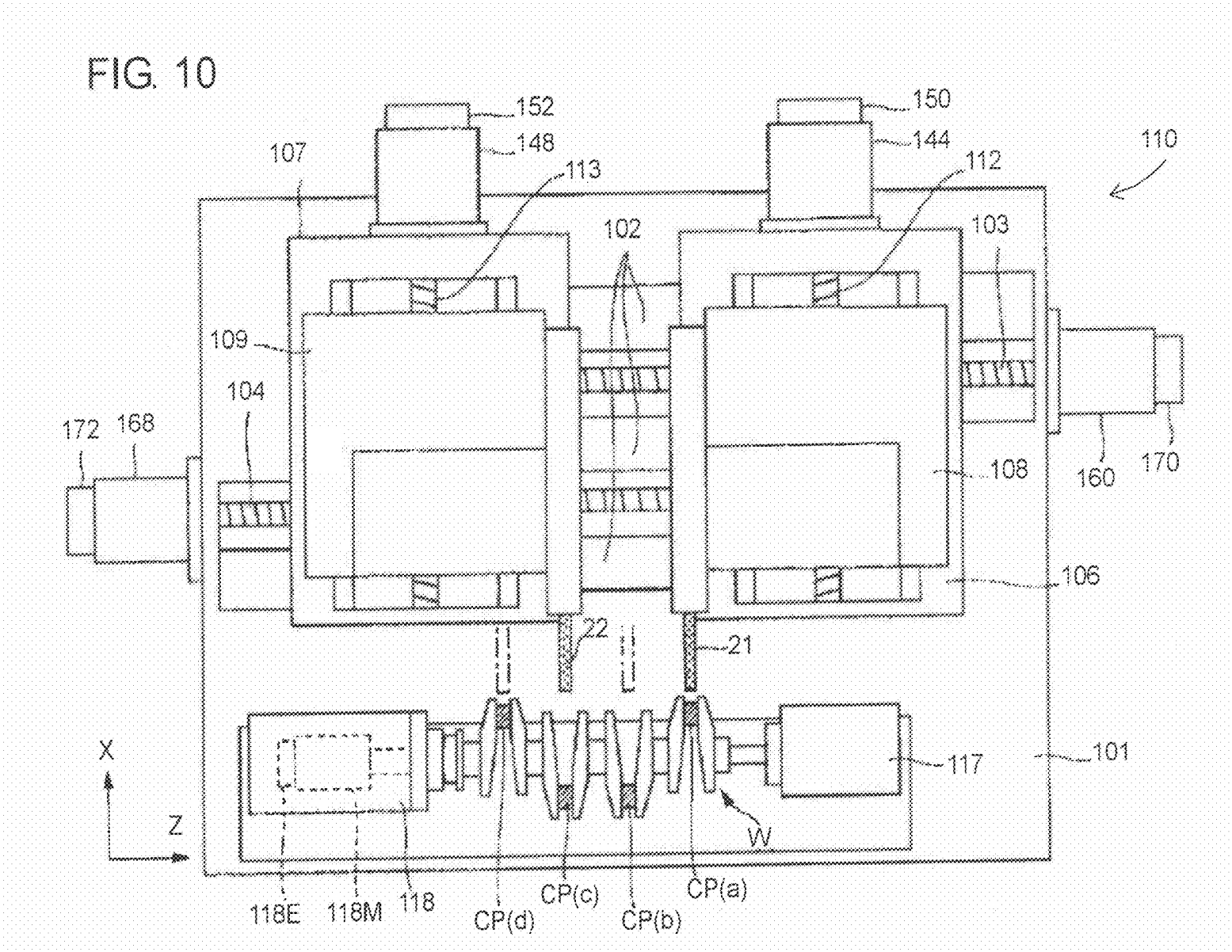
FIG. 10 is a schematic plan view of a grinding machine in a second embodiment according to the present invention.

In the twin-head grinding machine 110 in the second embodiment shown in FIG. 10, left and right wheel heads 108, 109 being two machining heads are provided to be slidable in a left-right direction as well as in a forward-rearward direction, and a work head 118 and a foot stock 117 are provided for supporting a workpiece W by means of a pair of centers (not shown) on an axis parallel to both of wheel spindles (not shown) of the left and right wheel heads 108, 109. More specifically, on a bed 101, a right-side Z-axis table 106 mounting the right wheel head 108 thereon is provided to be slidden by a feed screw 103 on and along Z-axis guide rails 102 extending in a longitudinal left-right direction (Z-axis direction), and in the same row as the right-side Z-axis table 106, a left-side Z-axis table 107 mounting the left wheel head 109 thereon is mounted to be slidden by another feed screw 104 on and along the Z-axis guide rails 102 in the longitudinal left-right direction (Z-axis direction).

On the left and right-side Z-axis tables 106, 107, the wheel heads 108, 109 respectively rotatably carrying the first and second grinding wheels 21, 22 are provided to be slidden by respective feed screws 112, 113 in the forward-rearward direction (X-axis direction) perpendicular to the longitudinal left-right direction (Z-axis direction). The work head 118 is provided therein with a work spindle (not numbered) which extends in parallel to the aforementioned wheel spindles to be rotated by a work spindle drive servomotor 118M, and is constructed to be able to drivingly rotate a workpiece W with a chuck or the like gripping an end of the workpiece W. On the other hand, the foot stock 117 is constructed to support the other end of the workpiece W by its center (not shown) on the axis of the work spindle.

The respective feed screws 112, 113 are connected to be rotatable by servomotors 144, 148 with respective encoders 150, 152, and the servomotors 144, 148 are controllable by a control device (not shown) like the numerical controller 40 shown in FIG. 1. A servomotor 160 with an encoder 170 is provided at a right end of the feed screw 103 for moving the right-side Z-axis table 106 with the right wheel head 108 mounted thereon in the longitudinal left-right direction (Z-axis direction). Likewise, a servomotor 168 with an encoder 172 is provided at the left end of the feed screw 104 for the left-side Z-axis table 107. Further, on the respective left and right-side Z-axis tables 106, 107, the servomotors 144, 148 with the encoders 150, 152 are provided to be connected to rear ends of the feed screws 112, 113 for sliding movements of the wheel heads 108, 109 in the forward-rearward (X-axis direction), respectively. The wheel heads 108, 109 rotatably carry the first and second grinding wheels 21, 22, and drive motors (not shown) for wheel driving are built in the wheel heads 108, 109, respectively.

In the twin-head grinding machine 110 of the general construction as described above, the workpiece W is supported between the work head 118 and the foot stock 117, and the right-side Z-axis table 106 is moved in the Z-axis direction to first index the first grinding wheel 21 to a machining position for the workpiece W where the first grinding wheel 21 is aligned with, for example, a crankpin CP(a) in the X-axis direction. During this and any subsequent movement of the right-side Z-axis table 106, if necessary, the left-side Z-axis table 107 with the left wheel head 109 mounted thereon is moved to a suitable position to avoid an interference with the index movement of the right-side Z-axis table 106. Then, the work spindle drive servomotor 11 8M with the encoder 11 8E provided in the work head 118 is driven to controllably rotate the workpiece W. At this time, since the workpiece W is rotated about the axis of journal portions thereof, the crankpin CP(a) revolves around the axis of the journal portions.

Thereafter, the X-axis feed screw 112 on the right-side Z-axis table 106 is rotated by the servomotor 144 to move back and forth the right wheel head 108 and hence, the first grinding wheel 21. During the movement, because the crankpin CP(a) being a machining portion is revolving, a rough grinding of the crankpin CP(a) is carried out with the first grinding wheel 21 as the right wheel head 108 is controlled by the control device (not shown) to move back and forth in synchronous relation with the rotation of the work spindle drive servomotor 118M. After the rough grinding of the crankpin CP(a) is completed with the retraction of the right wheel head 108 to a grinding start position, the right-side Z-axis table 106 is indexed to a position to bring the first grinding wheel 21 into alignment with a crankpin CP(b) in the X-axis direction, in which state, a rough grinding of the crankpin CP(b) is carried out. In the same manner as described above, rough grindings of crankpins CP(c) and CP(d) are carried out in turn.

After the rough grindings of the crankpins CP(a) to CP(d) are completed, the left-side Z-axis table 107 is indexed to a position where the second grinding wheel 22 faces the crankpin CP(a). During this and any subsequent movement of the left-side Z-axis table 107, if necessary, the right-side Z-axis table 106 is moved to a suitable position to avoid an interference with the index movement of the left-side Z-axis table 107. Thereafter, the X-axis feed screw 113 on the left-side Z-axis table 107 is rotated by the servomotor 148 to move the left wheel head 109 and hence, the second grinding wheel 22 back and forth. During the movement, because the crankpin CP(a) is revolving, a finish grinding of the crankpin CP(a) is carried out with the second grinding wheel 22 as the left wheel head 109 is controlled by the control device (not shown) to move back and forth in synchronous relation with the rotation of the work spindle drive servomotor 118M. After the finish grinding of the crankpin CP(a) is completed with the retraction of the left wheel head 109 to a grinding start position, the left-side Z-axis table 107 is indexed to a position to bring the second grinding wheel 22 into alignment with the crankpin CP(b) in the X-axis direction, in which state, a finish grinding of the crankpin CP(b) is carried out. In the same manner as described above, finish grindings of the crankpins CP(c) and CP(d) are carried out in turn. In a modified form of the grinding operation pattern, a rough grinding and a finish grinding may be carried out in succession on each of the crankpins CP(a) to CP(d) in such an order that, for example, the rough and finish grinding are carried out first on the crankpin CP(a), second on the crankpin CP(b), third on the crankpin CP(c) and finally, on the crankpin CP(d).

(Third Embodiment)

Figure 11:
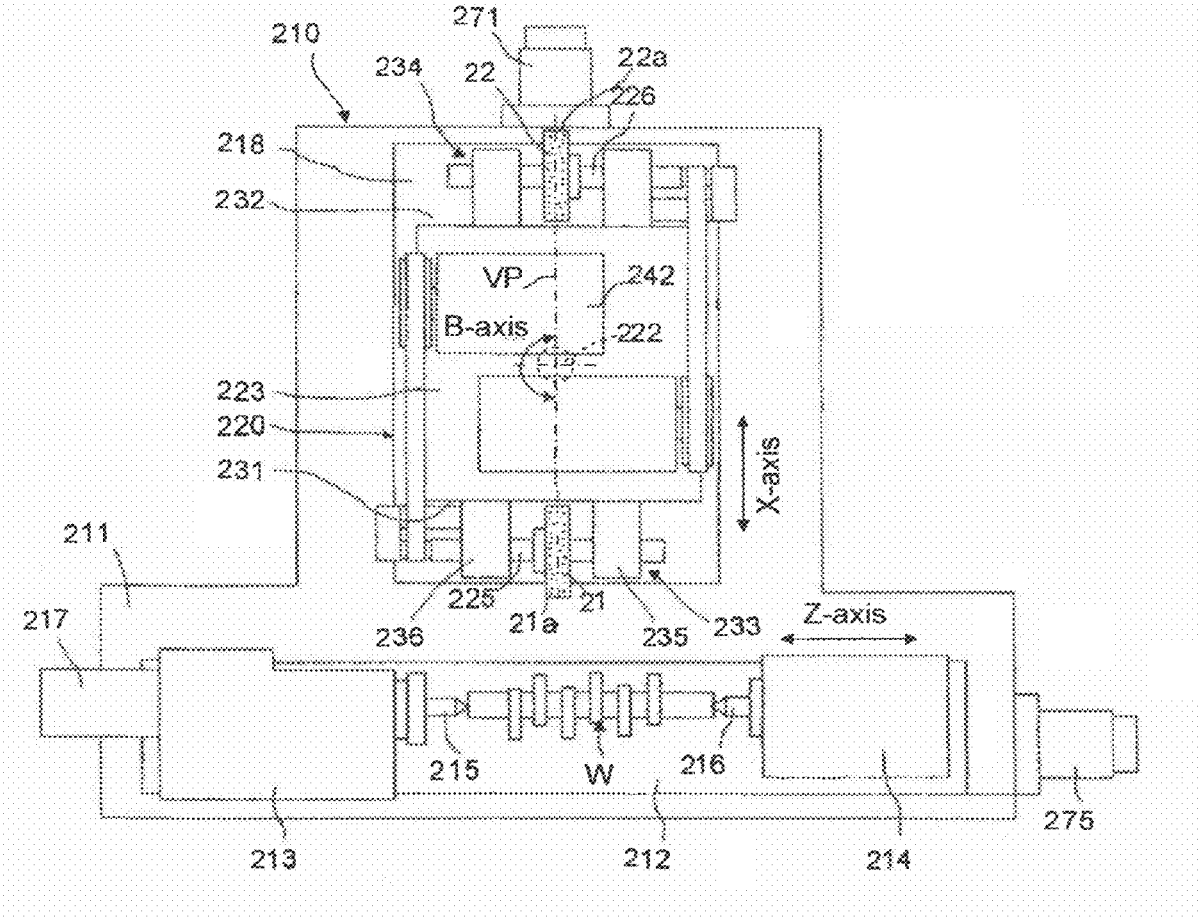
FIG. 11 is a schematic plan view of a grinding machine in a third embodiment according to the present invention.

In the grinding machine 210 with the swivel device in the third embodiment shown in FIG. 11, a work table 212 is movably guided on a bed 211 in a horizontal Z-axis direction and is movable by a Z-axis servomotor 275 in the Z-axis direction. A work head 213 and a footstock 214 are mounted on the work table 212 to face each other in the Z-axis direction and are respectively provided with centers 215, 216 for supporting opposite ends of a workpiece W. The workpiece W supported by the both centers 215, 216 is rotatable by a work spindle drive motor 217 mounted on the work head 213 through a drive pin member (not shown) about an axis parallel to the moving direction (Z-axis direction) of the work table 212.

Further, on the bed 211, a wheel head table 218 is guided to be movable in a horizontal X-axis direction perpendicular to the moving direction of the work table 212 and is moved by an X-axis servomotor 271 back and forth in the X-axis direction. A wheel head swivel device 220 is mounted on the wheel head table 218. The wheel head swivel device 220 is provided with a swivel base (not shown) fixed on the wheel head table 218 and a swivel head 223 arranged on the swivel base to be turnable about an upright swivel shaft 222, that is, about a B-axis in a horizontal plane. The upright swivel shaft 222 and hence, the B-axis is perpendicular to a plane including the axis of the workpiece W and the axes of two wheel spindles 225, 226. The swivel head 223 has opposite end surfaces, on which the two wheel spindles 225, 226 are supported to be rotatable respectively about horizontal axes which extend mutually in parallel relation, and the first grinding wheel 21 and the second grinding wheel 22 are respectively attached to the wheel spindles 225, 226. The first and second grinding wheels 21, 22 have the respective grinding surfaces 21*a*, 22*a* which are parallel to the wheel spindles 225, 226. The first and second grinding wheels 21, 22 are positioned so that a vertical plane VP across the axis of the upright swivel shaft 222 extends to be orthogonal to the grinding surfaces 21*a*, 22*a*.

The swivel head 223 of the wheel head swivel device 220 takes the form of a rectangular in a plan view. Of four lateral surfaces of the swivel head 223, two opposite lateral surfaces 231, 232 (hereafter referred to as "first lateral surface 231" and "second lateral surface 232") opposed to each other mount thereon first and second wheel support means or mechanisms 233, 234, respectively. The first and second wheel support mechanisms 233, 234 basically take the same construction, and therefore, the following description will be made regarding the construction of the first wheel support mechanism 233 provided on the first lateral surface 231. On the first lateral surface 231 of the swivel head 223, a pair of bearing units 235, 236 are provided with a predetermined space in the horizontal direction. The wheel spindle 225 is supported by these bearing units 235, 236 at both ends thereof and is rotatable about a horizontal axis. The wheel spindle 225 is positioned at an angular position where it becomes parallel to the rotational axis of the workpiece W when the swivel head 223 is turned about the swivel shaft 222.

In the twin-head grinding machine 110 in the foregoing second embodiment, the first and second grinding wheels 21, 22 are indexed by parallelly moving the two wheel heads 108, 109. In the grinding machine 210 with the swivel device in the third embodiment, on the contrary, the first and second grinding wheels 21, 22 are indexed by turning the wheel head swivel device 220, and except for this difference, the grinding machine 210 can grind the workpiece W in the same manner of operation as the twin-head grinding machine 110.

Figure 12:
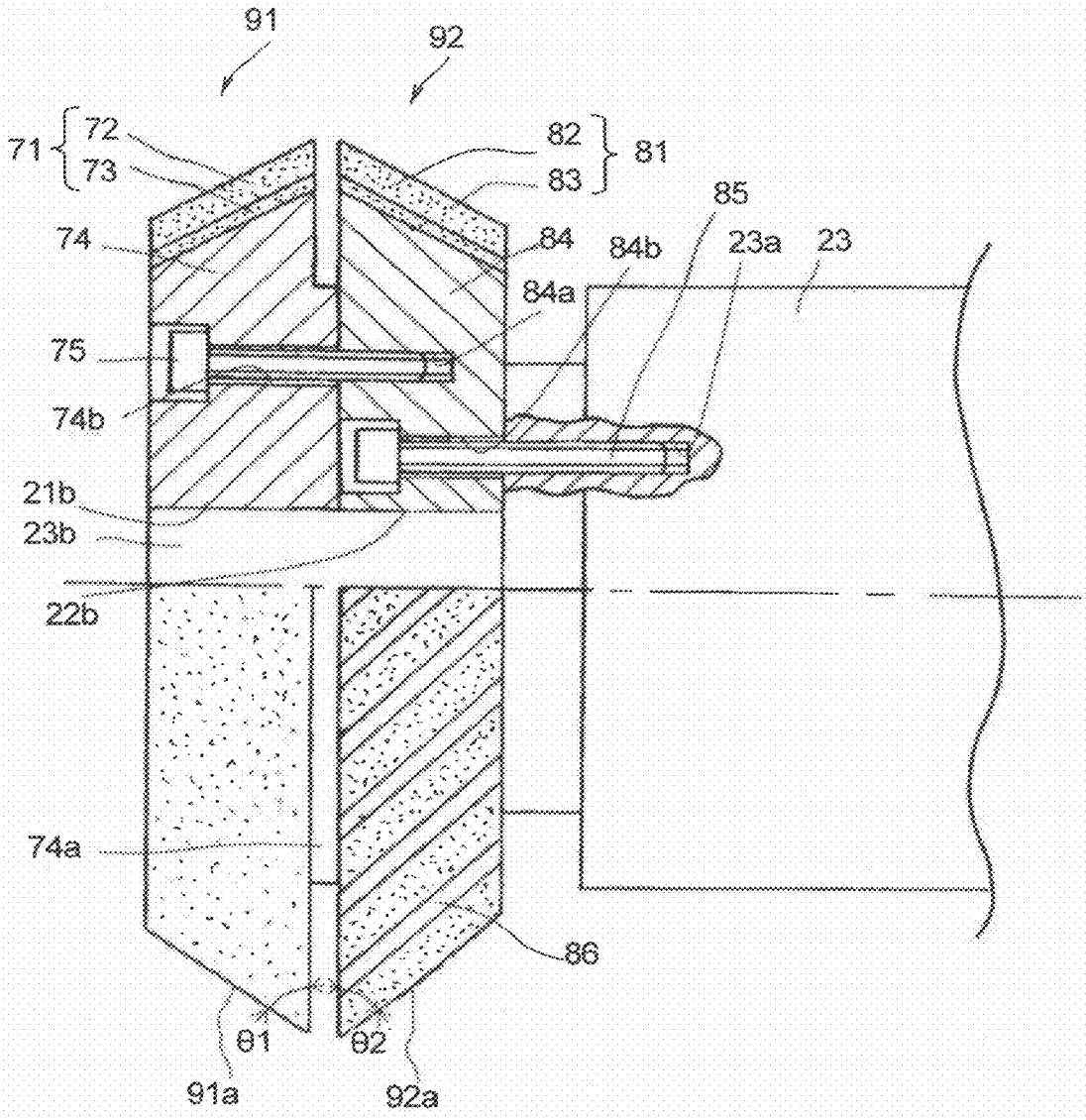
FIG. 12 is a front view showing, partly in section, first and second grinding wheels in a modified form and a mounting mechanism therefor.

In the grinding machine 10 in the foregoing first embodiment, the first grinding wheel 21 and the second grinding wheel 22 are supported to be juxtaposed on the wheel spindle 23 with the respective grinding surfaces 21*a*, 22*a* formed to extend in parallel to the Z-axis direction. With this configuration, where the workpiece is, for example, a camshaft having cams which are different in angular phase between those adjoining, it is liable that during the grinding of one cam with the first grinding wheel 21, the second grinding wheel 22 is brought into interference with another cam adjoining the one cam. To avoid this inconvenience, a modification is made, in which as shown in FIG. 12, a grinding surface 91*a* of a first grinding wheel 91 is formed to be inclined so that the angle θ1 relative to a right end surface of the first grinding wheel 91 becomes an acute angle, while a grinding surface 92*a* of a second grinding wheel 92 is formed to be inclined so that the angle θ2 relative to a left end surface of the second grinding wheel 92 becomes an acute angle. Other components or portions of the first and second grinding wheels 91, 92 which are the same in construction as those of the first and second grinding wheels 21, 22 in the foregoing first embodiment are designated by the same reference numerals as used in the first embodiment.

Figure 13A:
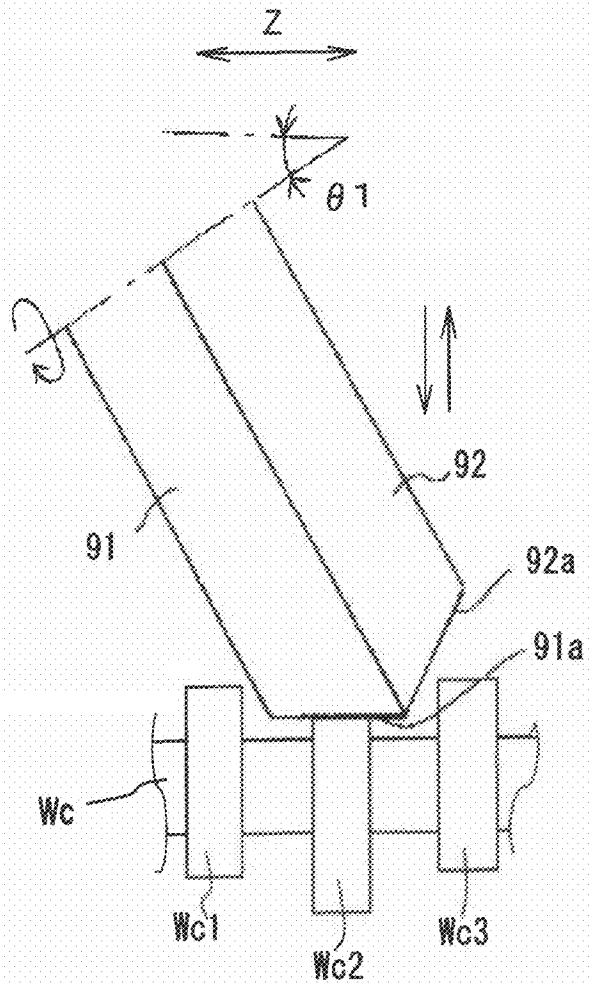
FIGS. 13(A) and 13(B) are illustrations showing grinding examples performed with the first and second grinding wheels shown in FIG. 12.
Figure 13B:
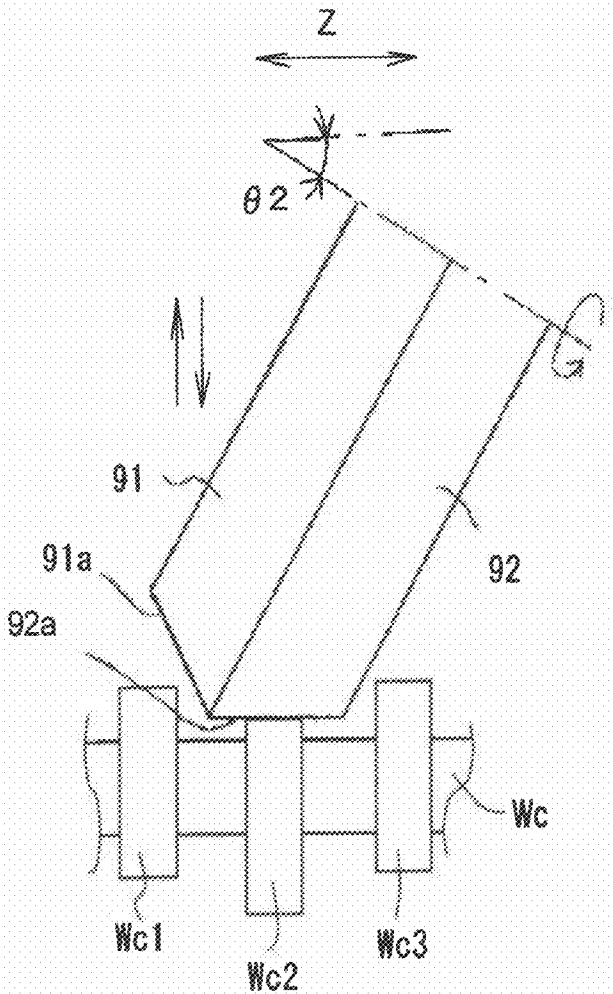

The first and second grinding wheels 91, 92 of the construction described above are attached to the wheel spindle 225 of the grinding machine 210 with the swivel device in the third embodiment having been described with reference to FIG. 11. Then, as shown in FIG. 13(A), the swivel head 223 is turned left to incline the wheel spindle 225 by the complement (90−θ1) of the angle θ1 from the state that it is parallel to the Z-axis direction, and the wheel head table 218 is advanced toward a camshaft Wc, whereby a cam Wc2 can be roughly ground with the first grinding wheel 91. Then, after the wheel head table 218 is retracted to a grinding start position, the swivel head 223 is turned right to bring the wheel spindles 225, 226 into parallel to the Z-axis direction and is further turned right by the complement (90−θ2) of the angle θ2, as shown in FIG. 13(B). After this, the wheel head table 218 is advanced toward the camshaft Wc, whereby the cam Wc2 can be finished with the second grinding wheel 92.

During each of the rough and finish grinding operations, because the grinding surface 91*a* of the first grinding wheel 91 and the grinding surface 92*a* of the second grinding wheel 92 are inclined in opposite directions, it does not take place that during the rough grinding with the first grinding wheel 91, the second grinding wheel 92 interferes with an adjoining cam Wc3 different in angular phase, and it also does not take place that during the finish grinding with the second grinding wheel 92, the first grinding wheel 91 interferes with another adjoining cam Wc1 different in angular phase. In particular, the prevention of the aforementioned interference is effective where the adjoining cams Wc1, Wc2 and Wc3 different in angular phase from one another have short axial spaces or clearances therebetween. Where there is ground a workpiece taking a cylindrical shape, rough and finish traverse grindings can be done respectively with the first grinding wheel 91 and the second grinding wheel 92.

Further, where the grinding surface 91*a* is formed to be inclined so that the angle θ1 which it makes with the right end surface of the first grinding wheel 91 becomes an acute angle as described above, the first grinding surface 91*a* is liable to suffer a local wear or abrasion due to a difference in circumferential speed between both axial end portions thereof as a result of being used in a heavy grinding like the rough grinding. To avoid this shortcoming, a further modification may be made, wherein a first grinding wheel for rough grinding is configured like the aforementioned first grinding wheel 21 having the plane grinding surface 21*a* formed to extend in parallel to the Z-axis direction as shown in FIG. 2, while only a second grinding wheel for finish grinding is configured like the aforementioned second grinding wheel 92 having the obliquely grooved grinding surface 92*a* inclined to make the angle θ2 relative to the left end surface an acute angle as shown in FIG. 12.

Figure 15:
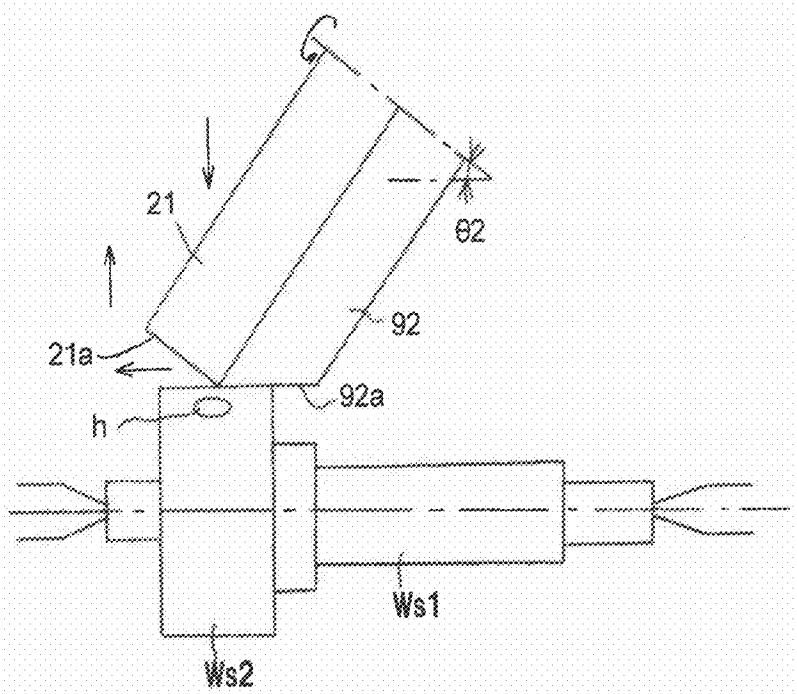
FIG. 15 is an illustration showing a grinding example performed with the second grinding w heel shown in FIG. 14.
Figure 14:
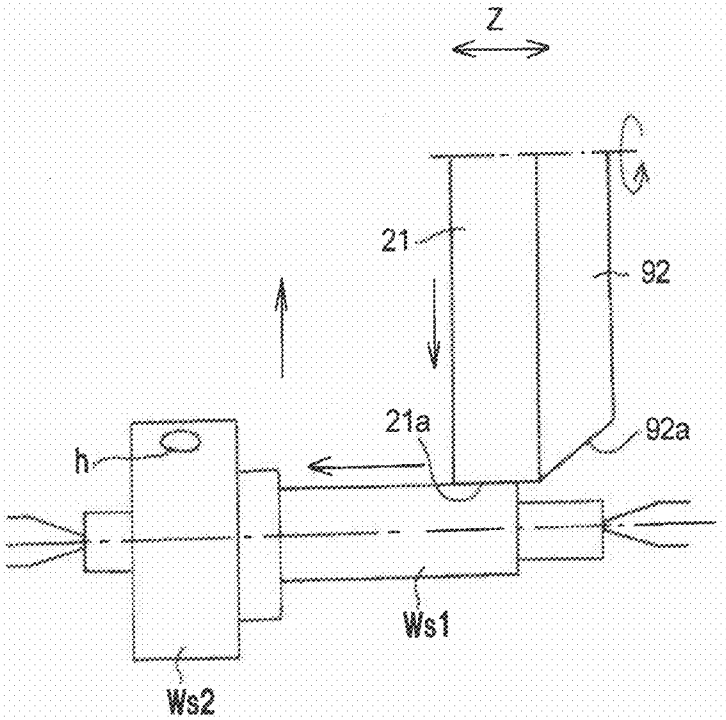
FIG. 14 is an illustration showing a grinding example performed with a first grinding wheel of first and second grinding wheels in a further modified form.

The first and second grinding wheels 21, 92 of the construction described above are attached to the wheel spindle 225 of the grinding machine 210 with the swivel device in the third embodiment having been described with reference to FIG. 11. Then, as shown in FIG. 14, the wheel head table 218 is advanced toward a small-diameter shaft portion Ws1 (i.e., smooth cylindrical portion with no hole or groove formed thereon) of a stepped workpiece W, with the wheel spindle 225 maintained in parallel to the Z-axis direction, and the first grinding wheel 21 is infed a predetermined infeed amount against the small-diameter shaft portion Ws1. Then, the work table 212 is moved in the Z-axis direction, whereby the small-diameter shaft portion Ws1 can be ground in a traverse grinding mode. Further, after the retraction of the wheel head table 218 to a grinding start position, the swivel head 223 is turned right to incline the wheel spindle 225 by the complement (90−θ2) of the angle θ2 from the state that the wheel spindle 225 is parallel to the Z-axis direction, as shown in FIG. 15, and the wheel head table 218 is advanced to move the second grinding wheel 92 to a position adjacent to the right end of a large-diameter shaft portion Ws2 (i.e., non-smooth or uneven cylindrical portion) having an oil hole h or the like thereon. Thereafter, the second grinding wheel 92 is infed a predetermined infeed amount against the large-diameter shaft portion Ws2, and then, the work table 212 is moved in the Z-axis direction, whereby the large-diameter shaft portion Ws2 can be ground with the second grinding wheel 92 in the traverse grinding mode.

During the traverse grinding with the first grinding wheel 21, the left end surface of the first grinding wheel 21 is perpendicular to the grinding surface 21 a, while the grinding surface 92*a* of the second grinding wheel 92 is inclined in a direction to go away from the small-diameter shaft portion Ws1. Therefore, it does not occur that the second grinding wheel 92 interferes with the small-diameter shaft portion Ws1, so that it can be realized to grind the whole length of the small-diameter shaft portion Ws1 with the first grinding wheel 21 in the traverse grinding mode. Further, during the traverse grinding with the second grinding wheel 92, because the oblique grooves 86 are formed on the grinding surface 92*a* of the second grinding wheel 92, it does not occur that the oil hole h formed on the large-diameter shaft portion Ws2 causes a dynamic pressure generated in coolant to fluctuate with the result of varying the distance which the large-diameter shaft portion Ws2 goes away from the second grinding wheel 92. Therefore, it becomes possible to precisely grind the large-diameter shaft portion Ws2 with the oil hole h in the traverse grinding mode. At this time, since the grinding wheel 21*a* of the first grinding wheel 21 is maintained inclined to go way from the large-diameter shaft portion Ws2 and since there is no portion protruding from the shaft portion Ws2 largest in diameter, it does not occur that the first grinding wheel 21 interferes with the largest shaft portion Ws2, so that it becomes possible to grind the whole length of the large-diameter shaft portion Ws2 with the second grinding wheel 92 in the traverse grinding mode.

In the foregoing embodiments, the first grinding wheel 21, 91 and the second grinding wheel 22, 92 are constructed as discrete bodies, there may be used an integrated wheel structure with the first and second grinding wheels formed on the outer circumferential surface of a single core. Where the first and second grinding wheels are integrated like this, the integrated grinding wheel becomes easier in maintenance in comparison with the case where the first and second grinding wheels are constructed independently. Although the first grinding wheel 21, 91 and the second grinding wheel 22, 92 are constructed by using the segmented wheel chips 71, 81, each of them may be constructed as one-piece or solid grinding wheel. Alternatively, they may be constructed in the form of a formed grinding wheel. Further, although the order in attaching the first grinding wheel 21, 91 and the second grinding wheel 22, 92 is such that the first grinding wheel 21, 91 is placed outside the second grinding wheel 22, 92 with respect to the support mechanism therefor, the order may be reversed. In addition, it has heretofore been required to mount equipments such as a coolant flow volume switching valve, piping, a flow meter or the like on a grinding machine for the purpose of precisely grinding workpieces with oil holes or the like, the use of the obliquely grooved second grinding wheel 22, 92 makes the equipments unnecessary, so that it becomes possible to reduce the manufacturing cost for the grinding machine with the obliquely grooved second grinding wheel 22, 92.

Various features and many of the attendant advantages in the foregoing embodiments will be summarized as follows:

In the grinding machines 10, 110, 210 shown in FIGS. 1, 10, 11, since as shown in FIG. 2, the first grinding wheel 21 has the grinding surface 21*a* formed to be plane, whereas the second grinding wheel 22 has the plurality of oblique grooves 86 formed on the grinding surface 22*a* thereof to be inclined relative to the wheel circumferential direction, the accuracy in grinding with the second grinding wheel 22 and the service life of the second grinding wheel 22 can be improved for the following reasons. That is, the first grinding wheel 21 is a conventional grinding wheel with the grinding surface 21*a* formed to be plane and, even when used at such a grinding operation step as to shorten the service life of the second grinding wheel 22, does not suffer becoming remarkably short in service life. On the other hand, the second grinding wheel 22 is capable of releasing a dynamic pressure in coolant generated between the grinding surface 22*a* and the workpiece W since coolant supplied from the upside is discharged from both of the upper and lower sides of the contact surface S through at least one oblique groove 86. Therefore, without decreasing the supply quantity of coolant, it can be prevented that the workpiece W is displaced in a direction to go away from the second grinding wheel 22 due to a dynamic pressure in coolant or the distance which the workpiece W goes away from the second grinding wheel 22 varies upon fluctuations in the dynamic pressure generated in the coolant. As a result, it can be realized to enhance the accuracy in grinding the workpiece W with the second grinding wheel 22. Moreover, since the first grinding wheel 21 is used in such a grinding operation step as to shorten the service life of the second grinding wheel 22, it becomes possible to prolong the service life of the second grinding wheel 22.

Also in the grinding machines 10, 110, 210 shown in FIGS. 1, 10, 11 with the second grinding wheel 22 typically shown in FIGS. 4 to 7, where one side intersection point Ca is defined as an intersection point of each oblique groove 86 and an extension line L1 of one side edge parallel to the wheel circumferential direction of the contact surface S and the other side intersection point Cb is defined as an intersection point of each oblique groove 86 and an extension line L2 of the other edge, the other side intersection point Cb of each oblique groove 88 overlaps the one side intersection point Ca of an oblique groove 88 next to each such oblique groove 86 by the predetermined overlap amount V in the wheel circumferential direction. Thus, at least one oblique groove 86 vertically crosses the contact surface S on which the grinding surface 22*a* of the second grinding wheel 22 contacts the workpiece W, and thus, is capable of releasing a dynamic pressure in coolant generated between the grinding surface 22*a* and the workpiece W since coolant supplied from the upside flows out from both of the upper and lower sides of the contact surface S through the at least one oblique groove 86. Therefore, without decreasing the supply quantity of coolant, it can be prevented that the workpiece W is displaced in a direction to go away from the second grinding wheel 22 due to a dynamic pressure in coolant or the distance which the workpiece W goes away from the second grinding wheel varies upon fluctuations in the dynamic pressure generated in the coolant. As a result, it can be realized to enhance the accuracy in grinding the workpiece W with the second grinding wheel 22. Moreover, since the first grinding wheel 21 is used in such a grinding operation step as to shorten the service life of the second grinding wheel 22, it becomes possible to prolong the service life of the second grinding wheel 22.

Also in the grinding machines 10, 110, 210 shown in FIGS. 1, 10, 11, with it being taken into consideration that the effect of the oblique grooves 88 in reducing the dynamic pressure generated in coolant is proportional to the width w0 (=w1+w2 of the oblique groove 88, the oblique grooves 88 are grooved so that the width w0(=w1+w2) of the oblique groove 88 becomes constant over the whole circumferential surface of the grinding surface 22*a* of the second grinding wheel 22. Therefore, the dynamic pressure reduction effect becomes constant over the whole circumference of the grinding surface 22*a*, so that it becomes possible to grind the workpiece W without ununiformity thereon.

Also in the grinding machines 10, 110, 210 shown in FIGS. 1, 10, 11, the first grinding wheel 21 is used for rough grindings which are high in efficiency, much in metal removal amount and large in influence on wheel wear, whereas the second grinding wheel 22 is used in finish grindings which are low in efficiency, a little in wheel wear and large in influence on machining accuracy. As a result, it can be realized to enhance the accuracy in grinding with the second grinding wheel 22 and to prolong the service life of the second grinding wheel 22.

Also in the grinding machines 10, 110, 210 shown in FIGS. 1, 10, 11, since the second grinding wheel 22 with the oblique grooves 86, 88, 89 formed on the grinding surface 22*a* is capable of releasing a dynamic pressure in coolant generated between the grinding surface 22*a* and the workpiece W and since it does not occur that fluctuations in the dynamic pressure generated in coolant cause the distance which the workpiece W goes away from the second grinding wheel 22, to vary, the machining accuracy can be enhanced also in grinding a workpiece with a non-smooth or uneven cylindrical surface Ws2 (FIG. 15) which has one or more holes h or grooves or the like formed thereon.

Also in the grinding machines 10, 110, 210 shown in FIGS. 1, 10, 11, the first grinding wheel 21 and the second grinding wheel 22 are provided for selective use, it can be realized to perform the grinding with the first grinding wheel 21 and the grinding with the second grinding wheel 22 in succession, so that steps required for the grindings can be reduced.

Also in the grinding machine 10 typically shown in FIGS. 1 and 2, since the first grinding wheel 21 is arranged axially outside the second grinding wheel 22 with respect to the wheel spindle 23, it becomes possible to easily replace the first grinding wheel 21 only when the same reaches the end of the service life faster than the second grinding wheel 22. Since the second grinding wheel 22 is fastened only on the wheel spindle 23, whereas the first grinding wheel 21 is fastened only on the second grinding wheel 22, it becomes possible to replace the first grinding wheel 21 only by unfastening the same, so that the man hour for the replacing work can be decreased. Moreover, since it is not required to detach the second grinding wheel 22 from the wheel spindle 23, the alignment of the grinding surface 22*a* with the axis of the wheel spindle 23 can remain unchanged, so that the position on the grinding surface 22*a* of the second grinding wheel 22 can be maintained precisely.

Also in the grinding machine 10 typically shown in FIGS. 1 and 2, since the first grinding wheel 21 and the second grinding wheel 22 are juxtaposed with the axial space or clearance therebetween, the truing tool or roll 32 can once escape into the clearance after truing the first grinding wheel 21 without interfering with the second grinding wheel 22. Thereafter, the second grinding wheel 22 can be trued in succession, so that it becomes possible to decrease the steps taken for truing the both grinding wheels 21, 22.

Also in the grinding machine 210 shown in FIG. 11 where modified to mount either the grinding wheels shown in FIG. 12 or the grinding wheels shown in FIG. 14, since at least the grinding surface 92*a* of the second grinding wheel 92 is formed to be an inclined surface as shown in FIGS. 12 and 14, the swivel head 223 serving as a wheel head is required to be turned about the B-axis perpendicular to the plane including the axis of the workpiece W and the axis of the wheel spindle 225 to incline the axis of the wheel spindle 225. Therefore, even where the workpiece W is, for example, a camshaft having adjoining cams Wc1, Wc2, W3 different in angular phase, the grinding surface 92*a* of the second grinding wheel 92 is withdrawn from an adjoining cam Wc3 during the grinding operation with the first grinding wheel 91 or 21, so that it becomes possible to prevent the second grinding wheel 92 from interfering with the adjoining cam Wc3. During the grinding operation with the second grinding wheel 92, on the other hand, the grinding surface 91*a*, 21*a* of the first grinding wheel 91 or 21 is withdrawn from an adjoining cam Wc1, so that it becomes possible to prevent the first grinding wheel 91 or 21 from interfering with the adjoining cam Wc1. Further, since during the grinding operation with one of the grinding wheels 92, the other grinding wheel 91 or 21 does not take part in the grinding operation, it becomes possible to perform a traverse grinding using either one of the first and second grinding wheels 91 or 21, 92.

In the grinding method described above, since the grinding operation with the first grinding wheel 21 having the grinding surface 21*a* formed to be plane and the grinding operation with the second grinding wheel 22 having the plurality of oblique grooves 86 inclined relative to the wheel circumferential direction are selectively performed in dependence on the steps of grinding operations, the accuracy in grinding with the second grinding wheel 22 and the service life of the second grinding wheel 22 can be improved for the reasons mentioned earlier in connection with the grinding machine.

Also in the grinding method described above, the first grinding wheel 21 is used for rough grindings which are high in efficiency, much in metal removal amount and large in influence on wheel wear, whereas the second grinding wheel 22 is used in finish grindings which are low in efficiency, a little in wheel wear and large in influence on machining accuracy. As a result, it can be realized to enhance the accuracy in grinding with the second grinding wheel 22 and to prolong the service life of the second grinding wheel 22.

Also in the grinding method described above, since the second grinding wheel 22 with the oblique grooves 86, 88, 89 formed on the grinding surface 22*a* is capable of releasing a dynamic pressure in coolant generated between the grinding surface 22*a* and the workpiece W and since it does not occur that fluctuations in the dynamic pressure generated in coolant cause the distance which the workpiece W goes away from the second grinding wheel 22, to vary, the machining accuracy can be enhanced also in grinding a workpiece with a non-smooth or uneven cylindrical surface Ws2 which has one or more holes h or grooves or the like formed thereon.

Obviously, further numerous modifications and variations of the present invention are possible in light of the above teachings. It is therefore to be understood that within the scope of the appended claims, the present invention may be practiced otherwise than as specifically described herein.

What is claimed is:

1. A grinding machine comprising:

a first grinding wheel comprises a grinding wheel having a grinding surface formed to be plane;

a second grinding wheel comprises a grinding wheel having a plurality of oblique grooves formed on a grinding surface thereof to be inclined relative to a wheel circumferential direction; and a coolant supply device configured to supply coolant to a location at which the first and second grinding wheels grind a workpiece, wherein the plurality of oblique grooves are inclined at a predetermined angle relative to the wheel circumferential direction and are formed at equiangular intervals in such an arrangement that where one side intersection point is defined as an intersection point of each oblique groove and an extension line of one side edge parallel to the wheel circumferential direction of the contact surface and the other side intersection point is defined as an intersection point of each oblique groove and an extension line of the other edge, the other side intersection point of each oblique groove overlaps the one side intersection point of an oblique groove next to each such oblique groove by a predetermined overlap amount in the wheel circumferential direction, and in grinding the workpiece with the second grinding wheel, an infeed amount of the second grinding wheel against the workpiece and at least one of the inclination angle and the intervals of the oblique grooves are set so that the length in the wheel circumferential direction of the contact surface on the grinding surface of the second grinding wheel and the workpiece becomes shorter than the overlap amount.

2. The grinding machine as set forth in claim 1, wherein a mechanism is provided to selectively bring the first and second grinding wheels before the workpiece to use the first grinding wheel in a rough grinding of the workpiece and to use the second grinding wheel in a finish grinding of the workpiece.

3. The grinding machine as set forth in claim 1, wherein a mechanism is provided to selectively bring the first and second grinding wheels before the workpiece to grind a smooth cylindrical surface portion of the workpiece with the first grinding wheel and to grind an uneven cylindrical surface portion of the workpiece with the second grinding wheel.

4. The grinding machine as set forth in claim 1, wherein the first and second grinding wheels are rotatably carried on opposite sides of a wheel head and wherein the mechanism comprises:

a wheel head swivel device for turning the wheel head about an axis perpendicular to a plane including the axis of the workpiece and the axes of the first and second grinding wheels.

5. The grinding machine as set forth in claim 1, wherein the first grinding wheel and the second grinding wheel are arranged in a juxtaposed relation on the same side of a wheel head.

6. The grinding machine as set forth in claim 5, wherein the first and second grinding wheels are juxtaposed by fitting and fastening the second grinding wheel on a wheel spindle of the grinding machine and then, by fitting the first grinding wheel on the wheel spindle and fastening the first grinding wheel on the second grinding wheel.

7. The grinding machine as set forth in claim 6, wherein the first and second grinding wheels are juxtaposed on the wheel spindle with a space therebetween in the axial direction of the wheel spindle.

8. The grinding machine as set forth in claim 5, wherein the first and second grinding wheels are arranged in the juxtaposed relation by being attached respectively on respective wheel spindles which are rotatably supported respectively by first and second wheel heads movable independently in the axial direction of the workpiece.

9. The grinding machine as set forth in claim 1, wherein:

at least the grinding surface of the second grinding wheel is formed to be inclined relative to the axis of the second grinding wheel.

10. The grinding machine as set forth in claim 9, wherein:

a wheel head rotatably supporting the first and second grinding wheels is constructed as a swivel head which is turnable about an axis extending to be perpendicular to a plane including the axis of the workpiece and the axis of a wheel spindle rotatably supported by the swivel head.

11. A grinding machine comprising:

a first grinding wheel comprises a grinding wheel having a grinding surface formed to be plane;

a second grinding wheel comprises a grinding wheel having a plurality of oblique grooves formed on a grinding surface thereof to be inclined relative to a wheel circumferential direction; and a coolant supply device configured to supply coolant to a location at which the first and second grinding wheels grind a workpiece, wherein:

the plurality of oblique grooves are inclined by a predetermined angle relative to the wheel circumferential direction and are formed on the grinding surface at equiangular intervals to open at both sides of the second grinding wheel so that a part of each oblique groove on one side of the second grinding wheel overlaps a part of a circumferentially adjoining oblique groove on the other side of the second grinding wheel by a predetermined overlap amount in the wheel circumferential direction; and in grinding the workpiece with the second grinding wheel, an infeed amount of the second grinding wheel against the workpiece and at least one of the inclination angle and the intervals of the oblique grooves are set so that the length in the wheel circumferential direction of the contact surface on the grinding surface of the second grinding wheel and the workpiece becomes shorter than the overlap amount.

12. The grinding machine as set forth in claim 11, wherein a mechanism is provided to selectively bring the first and second grinding wheels before the workpiece to use the first grinding wheel in a rough grinding of the workpiece and to use the second grinding wheel in a finish grinding of the workpiece.

13. The grinding machine as set forth in claim 11, wherein a mechanism is provided to selectively bring the first and second grinding wheels before the workpiece to grind a smooth cylindrical surface portion of the workpiece with the first grinding wheel and to grind an uneven cylindrical surface portion of the workpiece with the second grinding wheel.

14. The grinding machine as set forth in claim 11, wherein the first and second grinding wheels are rotatably carried on opposite sides of a wheel head and wherein the mechanism comprises:

a wheel head swivel device for turning the wheel head about an axis perpendicular to a plane including the axis of the workpiece and the axes of the first and second grinding wheels.

15. The grinding machine as set forth in claim 11, wherein the first grinding wheel and the second grinding wheel are arranged in a juxtaposed relation on the same side of a wheel head.

16. The grinding machine as set forth in claim 15, wherein the first and second grinding wheels are juxtaposed by fitting and fastening the second grinding wheel on a wheel spindle of the grinding machine and then, by fitting the first grinding wheel on the wheel spindle and fastening the first grinding wheel on the second grinding wheel.

17. The grinding machine as set forth in claim 16, wherein the first and second grinding wheels are juxtaposed on the wheel spindle with a space therebetween in the axial direction of the wheel spindle.

18. The grinding machine as set forth in claim 15, wherein the first and second grinding wheels are arranged in the juxtaposed relation by being attached respectively on respective wheel spindles which are rotatably supported respectively by first and second wheel heads movable independently in the axial direction of the workpiece.

19. The grinding machine as set forth in claim 11, wherein:

at least the grinding surface of the second grinding wheel is formed to be inclined relative to the axis of the second grinding wheel.

20. The grinding machine as set forth in claim 19, wherein:

a wheel head rotatably supporting the first and second grinding wheels is constructed as a swivel head which is turnable about an axis extending to be perpendicular to a plane including the axis of the workpiece and the axis of a wheel spindle rotatably supported by the swivel head.

21. A grinding machine comprising:

a first grinding wheel comprises a grinding wheel having a grinding surface formed to be plane;

a second grinding wheel comprises a grinding wheel having a plurality of oblique grooves formed on a grinding surface thereof to be inclined relative to a wheel circumferential direction; and a coolant supply device configured to supply coolant to a location at which the first and second grinding wheels grind a workpiece, wherein the sum of widths of adjoining oblique grooves which are within the contact surface on the grinding surface of the second grinding wheel and the workpiece and which exist on a cutting-plane line becomes constant at all times, the cutting-plane line being taken when radially cutting the second grinding wheel at an arbitrary position in the circumferential direction and in parallel to a wheel spindle of the grinding machine.

22. The grinding machine as set forth in claim 21, wherein a mechanism is provided to selectively bring the first and second grinding wheels before the workpiece to use the first grinding wheel in a rough grinding of the workpiece and to use the second grinding wheel in a finish grinding of the workpiece.

23. The grinding machine as set forth in claim 21, wherein a mechanism is provided to selectively bring the first and second grinding wheels before the workpiece to grind a smooth cylindrical surface portion of the workpiece with the first grinding wheel and to grind an uneven cylindrical surface portion of the workpiece with the second grinding wheel.

24. The grinding machine as set forth in claim 21, wherein the first and second grinding wheels are rotatably carried on opposite sides of a wheel head and wherein the mechanism comprises:

a wheel head swivel device for turning the wheel head about an axis perpendicular to a plane including the axis of the workpiece and the axes of the first and second grinding wheels.

25. The grinding machine as set forth in claim 21, wherein the first grinding wheel and the second grinding wheel are arranged in a juxtaposed relation on the same side of a wheel head.

26. The grinding machine as set forth in claim 25, wherein the first and second grinding wheels are juxtaposed by fitting and fastening the second grinding wheel on a wheel spindle of the grinding machine and then, by fitting the first grinding wheel on the wheel spindle and fastening the first grinding wheel on the second grinding wheel.

27. The grinding machine as set forth in claim 26, wherein the first and second grinding wheels are juxtaposed on the wheel spindle with a space therebetween in the axial direction of the wheel spindle.

28. The grinding machine as set forth in claim 25, wherein the first and second grinding wheels are arranged in the juxtaposed relation by being attached respectively on respective wheel spindles which are rotatably supported respectively by first and second wheel heads movable independently in the axial direction of the workpiece.

29. The grinding machine as set forth in claim 21, wherein:

at least the grinding surface of the second grinding wheel is formed to be inclined relative to the axis of the second grinding wheel.

30. The grinding machine as set forth in claim 29, wherein:

a wheel head rotatably supporting the first and second grinding wheels is constructed as a swivel head which is turnable about an axis extending to be perpendicular to a plane including the axis of the workpiece and the axis of a wheel spindle rotatably supported by the swivel head.

* * * * *